US009205303B2

(12) United States Patent
Blink et al.

(10) Patent No.: US 9,205,303 B2
(45) Date of Patent: Dec. 8, 2015

(54) GOLF BALL INCORPORATING IONOMERIC COMPONENT HAVING PROPERTY GRADIENTS

(75) Inventors: Robert Blink, Newport, RI (US); David A. Bulpett, Boston, MA (US)

(73) Assignee: Acushnet Company, Fairhaven, MA (US)

( * ) Notice: Subject to any disclaimer, the term of this patent is extended or adjusted under 35 U.S.C. 154(b) by 938 days.

(21) Appl. No.: 13/346,103

(22) Filed: Jan. 9, 2012

(65) Prior Publication Data

US 2013/0178310 A1 Jul. 11, 2013

(51) Int. Cl.

| | |
|---|---|
| ***A63B 37/06*** | (2006.01) |
| ***A63B 37/00*** | (2006.01) |
| ***A63B 45/00*** | (2006.01) |

(52) U.S. Cl.

CPC ..... *A63B 37/0003* (2013.01); *A63B 37/0024* (2013.01); *A63B 37/0039* (2013.01); *A63B 37/0092* (2013.01); *A63B 45/00* (2013.01); *A63B 37/0076* (2013.01); *A63B 37/0093* (2013.01)

(58) Field of Classification Search

CPC ..... A63B 37/0032; A63B 37/0036; A63B 37/0037; A63B 37/0044; A63B 37/0048; A63B 37/0049; A63B 37/0063; A63B 37/0069; A63B 37/0086

USPC ..... 473/373, 374

See application file for complete search history.

(56) References Cited

U.S. PATENT DOCUMENTS

| | | | | |
|---|---|---|---|---|
| 5,003,012 | A | 3/1991 | Chamberlain et al. | |
| 6,180,714 | B1 | 1/2001 | Ohira et al. | |
| 6,852,784 | B2 | 2/2005 | Sullivan | |
| 7,767,759 | B2 | 8/2010 | Kim | |
| 7,785,216 | B2 | 8/2010 | Hebert et al. | |
| 7,803,874 | B2 | 9/2010 | Egashira et al. | |
| 2002/0137849 | A1 | 9/2002 | Kerns et al. | |
| 2010/0222156 | A1 * | 9/2010 | Sullivan et al. | 473/372 |

OTHER PUBLICATIONS

"Acid Salts and the Structure of Inomers", Michael M. Coleman, Joon Y. Lee and Paul C. Painter, Macromolecules 1990, 23, 2339-2349, 1990 American Chemical Society.

* cited by examiner

*Primary Examiner* — Raeann Gorden
(74) *Attorney, Agent, or Firm* — Margaret C. Barker

(57) ABSTRACT

The present invention is directed to a golf ball comprising a core, a cover and optionally an intermediate layer disposed between the core and the cover, wherein at least one of the core, the at least one intermediate layer, and the cover comprises at least one of an ionomer and an acid copolymer and has at least one treated region that is treated with and comprises a reaction product of an organometallic composition and the at least one ionomer and/or acid copolymer, such that: the at least one treated region has an internal property gradient; or at least two treated regions, in tandem, have an external property gradient; or the at least one treated region and an untreated region, in tandem, have an external property gradient.

18 Claims, 14 Drawing Sheets

GOLF BALL INCORPORATING IONOMERIC COMPONENT HAVING PROPERTY GRADIENTS

FIELD OF THE INVENTION

The invention relates generally to golf balls incorporating materials and property gradients to optimize golfer performance.

BACKGROUND OF THE INVENTION

Golf balls, whether of solid or wound construction, generally include a core and at least a cover or outer coating. Solid golf balls, as compared with wound balls, provide better distance than wound balls due to their lower driver initial spin. Meanwhile, the wound construction provides a softer "feel" and higher spin rate—characteristics often preferred by accomplished golfers who are able to control the ball's flight and positioning.

The properties of a conventional solid ball may be modified by altering the typical single layer core and single cover layer construction to provide a ball having at least one intermediate layer disposed between the cover and the core. The core may be solid or fluid-filled, and may be formed of a single layer or one or more layers. Covers, in addition to cores, may also be formed of one or more layers. These multi-layer cores and covers are sometimes known as "dual core" and "dual cover" golf balls, respectively. One piece golf balls are also available. The difference in play characteristics resulting from these different types of constructions can be quite significant. The playing characteristics of multi-layer balls, such as spin and compression, can be tailored by varying the properties of one or more of the core, intermediate and/or cover layers.

By altering solid golf ball construction and composition, manufacturers can vary a wide range of playing characteristics such as resilience, durability, spin, and "feel", optimizing each according to various playing abilities and achieving a solid golf ball possessing feel characteristics more like their wound predecessors. For example, by shifting the density or mass of the golf ball toward the center of the ball, the moment of inertia of the golf ball can be reduced, thereby changing the spin decay of the ball. In this regard, core is the "engine" of the golf ball when hit with a club head. That is, the core is the golf ball's principal source of resiliency. Meanwhile, the intermediate layers based on ionomers may aid in maintaining initial speed, contribute to desired spin rate, and improve playability/impact durability as well as acting as a moisture barrier to protect the cores from COR loss. The cover, while intended to protect the golf ball from scuffing, may also be modified to target a desired spin rate, feel, and playability, and address such issues as lift and drag.

Accordingly, there is a need for golf balls configured with and incorporating materials in any or all of the core, intermediate layer and/or cover which improve performance, achieve superior golf ball durability, resilience and demonstrate a unique spin profile. In this regard, golf ball manufacturers have found that unique profiles may be achieved in golf balls having property gradients anywhere from the inner core toward the outer cover surface. For example, golf balls having a polyurethane or polyurea outer layer formed about an ionomer resin inner cover layer have been disclosed. Typical golf ball materials include ionomers and acid copolymers due to their durability and desirable performance characteristics such as scuff resistance and rebound. However, adhesion and durability difficulties often arise between layers due to incompatibility of the materials in those layers. Such difficulties increase manufacturing costs and create performance issues which negatively impact the golf ball manufacturer's reputation. Additionally, utilizing multiple layers to accomplish property gradients in a golf ball restricts the possible thickness range for each layer due to manufacturing limitations. Thus, golf ball manufacturers seek to develop golf balls which achieve desired playing characteristics without the aforementioned adhesion problems and layer thickness restrictions/limitations associated with the need to incorporate multiple layers in the golf ball in order to achieve property gradients. The present invention addresses these concerns by providing a golf ball comprising at least one property gradient within a center or at least one layer resulting from at least one treated region within the center and/or layer having been treated with a property-altering organometallic composition.

SUMMARY OF THE INVENTION

The present invention is therefore directed to a golf ball comprising a core, a cover and optionally an intermediate layer disposed between the core and the cover, wherein at least one of the core, the at least one intermediate layer, and the cover comprises at least one of an ionomer and an acid copolymer and has at least one treated region that is treated with and comprises a reaction product of an organometallic composition and the at least one ionomer and/or acid copolymer, such that: the at least one treated region has an internal neutralization gradient; or at least two treated regions, in tandem, have an external neutralization gradient; or the at least one treated region and an untreated region, in tandem, have an external neutralization gradient.

In another embodiment, the golf ball comprises a core, a cover and optionally an intermediate layer disposed between the core and the cover, wherein at least one of the core, the at least one intermediate layer, and the cover comprises at least one of an ionomer and an acid copolymer and has at least one treated region that is treated with and comprises a reaction product of an organometallic composition and the at least one ionomer and/or acid copolymer, such that: the at least one treated region has an internal property gradient; or at least two treated regions, in tandem, have an external property gradient; or the at least one treated region and an untreated region, in tandem, have an external property gradient.

In a further embodiment, the golf ball comprises a core, a cover and optionally an intermediate layer disposed between the core and the cover, wherein at least one of the core, the at least one intermediate layer, and the cover comprises a treated golf ball component comprising at least one of an ionomer and an acid copolymer and further comprises at least two regions, wherein at least one region is a treated region being treated with and comprising a reaction product of an organometallic composition and the at least one ionomer and/or acid copolymer, such that at least one of a hardness, a modulus and a melt flow of the at least two regions is different.

The term "organometallic composition" or "organometal" refers to any organic metal compound wherein the metal atom is bonded to a carbon atom. One such non-limiting example is the organometallic compound diethylzinc ($ZnEt_2$) having the structure:

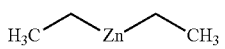

Another example comprises the organometallic compound n-butyllithium (n-BuLi), having the structure:

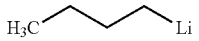

Herein, the term "golf ball component" refers to any and all of a core "center", core layer(s), intermediate layer(s), and cover layer(s). Additionally, the term "treated" shall refer, without limitation, to the ionomer and/or acid copolymer-comprising golf ball component being coated, rolled, dipped, soaked, sprayed, dusted, or otherwise exposed to the organometallic composition. The organometallic composition penetrates a golf ball component comprising at least one of an ionomer and an acid copolymer, reacts with the ionomer and/or copolymer, forming a metal neutralized polymeric reaction product thereby forming a treated region within the golf ball component forming at least one property gradient. A gradient may be located within a treated region itself, and/or between two different treated regions, and even between a treated region and an untreated region within the golf ball component.

A core "center" as used herein, may be a substantially spherical golf ball center, although golf balls of the invention may also include centers having any shape, including for example, having protuberances, etc.

Herein, "golf ball layer" shall refer to any layer formed about the center, such as an outer core layer, an intermediate layer, an inner cover layer and an outer cover layer. Embodiments are also envisioned wherein at least one of an ionomer and acid copolymer golf ball coating is treated with the organometallic composition.

The term "region" as used herein, may constitute any discrete area or volume within any of a center and a golf ball layer—whether treated or not treated. Thus, a "region" may include any of a "treated region", an "untreated region", a "first treated region" and a "second treated region", an innermost region, an outermost region, etc.

The term "treated region", as used herein, refers to a region within a golf ball component (center and/or golf ball layer) that is treated with and comprises a reaction product of an organometallic composition and the at least one ionomer and/or acid copolymer.

The term "untreated region", as used herein, refers to a region within the golf ball component that is not treated with—has not been exposed to—the organometallic composition.

In a golf ball of the invention, a region of a preformed center and/or golf ball layer is treated with the organometallic composition, creating a treated region having/displaying a property gradient either within the treated region itself or between the treated region and an untreated region or between the treated region and a second treated region within the pre-formed treated center or golf ball layer.

As used herein, the phrase "in tandem" refers to one region being adjacent to or surrounding another. For example, several constructions/arrangements are as follows with respect to a golf ball of the invention. A treated region may surround an untreated region within the golf ball component, or vice versa. Alternatively, a treated region may be adjacent to an untreated region within the golf ball component. A first treated region may surround a second treated region within the golf ball component. Two treated regions within the golf ball component may be adjacent to each other. Within a golf ball component, an untreated region may surround a first treated region, and meanwhile, be surrounded by a second treated region. Or, a first treated region may surround an untreated region and meanwhile be surrounded by a second treated region. Also, a first treated region may surround a second treated region which is surrounded by an untreated region. The aforementioned constructions are intended as non-limiting examples or illustrations of a golf ball according to the invention.

A treated region may have a uniform depth D or non-uniform depth. Since a golf ball component is always treated from a surface to a depth, the resultant treated region is measured inward from the treated golf ball component's treated surface. For example, where the golf ball component to be treated is an ionomer and/or acid copolymer comprising a cup or half shell, and the inside surface of the cup is being treated, the depth is measured from the cup's inside surface outward toward the cup's outer surface.

A non-uniform depth may be referred to or described in terms of $D_{ave}$ wherein $D_{ave}$ is an average depth based on equally-spaced, multiple measurements of the depth of a treated region within the treated golf ball component. $D_{ave}$ may vary depending on the number of depth measurements of a treated region having a non-uniform depth.

Where a center has a "radius", the radius comprises the distance from the center's geometric center to its outer surface. A treated region within that treated center may have a uniform depth of up to the entire radius the core. Thus, in one embodiment, depth D of the treated region comprises about 100% of the radius.

A treated center may alternatively comprise a treated region having a non-uniform depth. In some embodiments, the center may comprise a treated region having a depth of less than the entire radius. For example, depth D or $D_{ave}$ of a center's treated region may comprise from about 80% to about 99% of the radius of the core extending inward form the outer surface. In yet another embodiment, depth D or $D_{ave}$ of the treated region comprises from about 60% to about 80% of the radius of the center extending inward form the outer surface. In still another embodiment, depth D or $D_{ave}$ of the treated region comprises from about 40% to about 60% of the radius of the center extending inward form the outer surface. In an alternative embodiment, depth D or $D_{ave}$ of the treated region comprises from about 20% to about 40% of the radius of the center extending inward form the outer surface. In a different embodiment, depth D or $D_{ave}$ of the treated region comprises from about 15% to about 20% of the radius of the center extending inward form the outer surface. Depth D or $D_{ave}$ of the treated region may also comprise from about 10% to about 15%, or from about 8% to about 10%, from about 6% to about 8%, or from about 4% to about 6%, or from about 2% to about 4%, or from about 1% to about 2% of the radius of the center extending inward form the outer surface. Further, depth D or $D_{ave}$ of the treated region may comprise less than about 1% of the radius of the core, or even less than about 0.5% of the radius of the center, or even less than about 0.33% of the radius of the center, or even less than about 0.25% of the radius of the center, or even less than about 0.18% of the radius of the center or even less than about 0.05% of the radius of the center.

Where the treated golf ball component is a golf ball layer, the treated region may comprise a uniform depth of up to the entire thickness of the golf ball layer. Alternatively, a treated golf ball layer may comprise a treated region having either a uniform or non-uniform depth that is less than 100% of the total thickness of the treated layer. For example, the uniform or non-uniform depth of a treated region in a treated layer may be from about 10% to about 99% of the treated layer's entire thickness, or from about 20% to about 89%, or from about 30% to about 79%, or from about 40% to about 69%, or from about 50% to about 59%, or from about 10% to about 15%, or from about 15% to about 20%, or from about 20% to about 29% of the entire thickness of the treated golf ball layer.

Further, a treated golf ball layer comprising a treated region having a uniform or non-uniform depth may also comprise a depth that is less than about 10%, or less than about 7%, or less than about 5%, or less than about 2%, or less than about 1%, or less than about 0.75%, or less than about 0.5%, or less than about 0.33%, or less than about 0.25%, or less than about 0.18%, or less than about 0.09%, or less than about 0.05%, or less than about 0.01%, or even less than about 0.001% of the entire thickness of the treated golf ball layer.

In one embodiment of the golf ball of the invention, the golf ball center is the only golf ball component comprising a treated region. In an alternative embodiment, a core outer layer of the golf ball is the only golf ball component comprising the treated region. In another embodiment of the golf ball of the invention, the intermediate layer of the golf ball is the only golf ball component comprising the treated region. In yet another embodiment, the inner cover layer of the golf ball is the only golf ball component comprising the treated region. In still another embodiment of the golf ball of the invention, the outer cover layer is the only golf ball component comprising the treated region. Also, in other embodiments, multiple golf ball components within a single golf ball have treated regions. For example, one golf ball comprises a core outer layer and an intermediate layer, each having their own respective treated regions. Another golf ball comprises a core outer layer and an inner cover layer, each having a treated region. Many other combinations are possible in addition to these examples.

In one embodiment, the treated golf ball component comprises an untreated region and a treated region that is adjacent to the untreated region, wherein the untreated region has a depth that is less than a depth of the treated region. In another embodiment, the treated golf ball component comprises an untreated region and a treated region that is adjacent to the untreated region, wherein the untreated region has a depth that is greater than a depth of the treated region. In still another embodiment, the treated golf ball component comprises a first treated region and a second treated region that is adjacent to the first treated region, wherein the first treated region has a depth that is less than a depth of the second treated region. In a further embodiment, the treated golf ball component comprises a first treated region and a second treated region surrounding the first treated region, wherein the first treated region has a depth that is greater than a depth of the second treated region. In another golf ball of the invention, the treated golf ball component comprises a first treated region and a second treated region surrounding the first treated region, wherein the first treated region has a depth that is less than a depth of the second treated region. Different embodiments of a golf ball of the invention may be achieved by altering process conditions such as temperature and/or duration of treatment.

Herein, where a center or layer comprises multiple regions within it, an "inner" or "innermost region" of the center or layer is the region that is closest to the geometric center in the completed golf ball. In turn, an "outer" or "outermost region" of the center or layer is the region closest to the outer surface of the completed golf ball.

As used herein, the term organometallic composition includes but is not limited to at least one of an alkyl metal and/or an aryl metal. The alkyl group may comprise, for example, the formula $C_nH_{2n+1}$, wherein $1 \leq n \leq 8$. Alternatively, the alkyl may comprise the formula $C_nH_{2n+1}$, wherein $n>8$. The aryl group may comprise, for example, phenyls and substituted phenyls.

The organometallic composition may further include at least one aprotic solvent selected from the group comprising hexanes, heptanes, toluene, and xylene. The organometallic composition may also comprise at least one ether. One example of an ether includes a dialkylether selected from the group comprising diethyl ether and dibutyl ether.

As demonstrated in FIGS. 1A, 2A, 2B, 3A, 4A and 5, percent neutralization, hardness, and modulus are generally higher or greater closer to the surface being treated in a treated component of a golf ball of the invention. As used herein, the term "internal neutralization gradient" refers to any percentage point difference in the degree of neutralization within a treated region of a golf ball component. For example, a treated region may be 99 percent neutralized at a first depth and 90 percent neutralized at a second depth, the internal neutralization gradient therefore being 9 percent. Where a treated region is 75 percent neutralized at a first depth and 50 percent neutralized at a second depth, the internal neutralization gradient is 25 percent. Where a treated region is 100 percent neutralized at a first depth and 1 percent neutralized at a second depth, the internal neutralization gradient is 99 percent. Accordingly, in a golf ball of the invention, the internal neutralization gradient may be up to about 100 percent. In one embodiment, the internal neutralization gradient is from about 95 percent to about 100 percent. In another embodiment, the internal neutralization gradient is from about 90 percent to about 99 percent. In yet another embodiment, the internal neutralization gradient is from about 82 percent to about 92 percent. In still another embodiment, the internal neutralization gradient is from about 74 percent to about 83 percent. In an alternative embodiment, the internal neutralization gradient is from about 66 percent to about 75 percent, or from about 59 percent to about 68 percent, or from about 53 percent to about 60 percent, or from about 47 percent to about 55 percent, or from about 40 percent to about 49 percent. In a different embodiment, the internal neutralization gradient is from about 35 percent to about 43 percent, or from about 29 percent to about 37 percent, or from about 23 percent to about 31 percent.

The internal neutralization gradient may also be less than about 30 percent, or less than about 25 percent, or less than about 20 percent, or less than about 15 percent, or less than about 10 percent, or less than about 5 percent, or less than about 3 percent, or less than about 2 percent, or less than about 1 percent, or less than about 0.50 percent, or less than about 0.33% percent, or less than about 0.19 percent, or less than about 0.050 percent, or even less than about 0.005 percent.

An embodiment is also envisioned in which the internal neutralization gradient is zero. This would occur, for example, where the entire depth of the treated region is neutralized such that the entire depth of the treated region has equal neutralization. See, e.g., FIG. 6. In such an embodiment, this uniform resultant percent neutralization in the treated region would, however, be different than the region's pre-treatment percent neutralization. For example, pre-treatment, the entire depth of a region may be 90 percent neutralized, while post treatment, that same entire depth measures as being 100 percent neutralized. In such a case, the method of the invention therefore easily and cost effectively produces a golf ball having 100 percent neutralization within a single golf ball component.

In addition, an "average rate of change" within a treated region from one % neutralization measurement point to another may be determined by the formula: $(\Delta N)/(\Delta D)$ where $\Delta N$ is percentage point difference in degree of neutralization and $\Delta D$ is the distance (or depth) between two percent neutralization measurement points.

As used herein, the term "external neutralization gradient", for a center, refers to any percentage point difference in degree of neutralization between the geometric center of an inner region and the surface of an outer region, wherein at least the outer region is treated. The inner region is adjacent the center's geometric center, and the outer region is the region that is adjacent the center's outer surface.

For example, the geometric center of an untreated inner region may be 99 percent neutralized while the surface of a treated outer region is 100 percent neutralized, the external neutralization gradient therefore being 1 percent. Since a center will always be treated from its surface inward, the outer region will always comprise a treated region when the center is subjected to at least a single treatment. And an inner region will be untreated where the organometallic composition does not penetrate the entire distance from the surface to the geometric center.

However, multiple treated regions are possible within a center that has been subjected to multiple treatments. See, for example, FIGS. 7A, 7B, and 7C). In each of these figures, a center is treated twice. In FIG. 7A, the organometallic composition penetrates the center more deeply in the first treatment ($D_1$) than in the second ($D_2$), producing two treated regions 1, 2 and one untreated region 3. In FIG. 7C, the organometallic composition penetrates the center more deeply in the second treatment ($D_2$) than in the first ($D_1$), once again producing two treated regions 6, 7 and one untreated region 8. In contrast, in FIG. 7B, the organometallic composition's penetration of the center is equally deep in the second treatment ($D_2$) and the first treatment ($D_1$), thereby producing one treated region (4) and one untreated region (5) in the treated center. In one embodiment, the center comprises up to n+1 regions as a result of n treatments. In another embodiment, the center comprises n treated regions as a result of n treatments.

As used herein, the term "external neutralization gradient", with respect to a golf ball layer, refers to any percentage point difference in degree of neutralization between the surfaces of either two treated regions within the golf ball layer or a treated region and an untreated region within the golf ball layer. For example, a golf ball may have an intermediate layer comprising three regions (an innermost region, and outermost region and a third region between the innermost and outermost regions), the innermost and outermost regions both being treated regions. In this golf ball, the surface of the innermost region is 95 percent neutralized and the surface of the outermost region is 100 percent neutralized. Accordingly, the external neutralization gradient is 5 percent.

Accordingly, in a golf ball of the invention, the external neutralization gradient may be up to about 100 percent. In one embodiment, the external neutralization gradient is from about 92 percent to about 100 percent. In another embodiment, the external neutralization gradient is from about 94 percent to about 99 percent. In yet another embodiment, the external neutralization gradient is from about 90 percent to about 96 percent. In still another embodiment, the external neutralization gradient is from about 82 percent to about 92 percent. In an alternative embodiment, the external neutralization gradient is from about 74 percent to about 84 percent. In a different embodiment, the external neutralization gradient is from about 68 percent to about 77 percent, or from about 60 percent to about 72 percent, or from about 50 percent to about 63 percent, or from about 35 percent to about 50 percent, or from about 20 percent to about 37 percent, or from about 10 percent to about 22 percent.

The external neutralization gradient may also be less than about 24 percent, or less than about 18 percent, or less than about 12 percent, or less than about 10 percent, or less than about 7 percent, or less than about 3 percent, or less than about 2 percent, or less than about 1 percent, or less than about 0.80 percent, or less than about 0.50 percent or less than about 0.25 percent or less than about 0.17 percent, or less than about 0.09 percent, or less than about 0.03 percent, or less than about 0.007 percent, or even less than about 0.002 percent.

Herein, the term "internal property gradient" refers to a measured difference with respect to a certain property within a treated region of a golf ball component. A "property" includes neutralization, hardness, modulus, and melt flow as well as any other related properties which a person of ordinary skill in the art would expect to also vary or change when neutralization, hardness, modulus and melt flow change. Where the property gradient relates to neutralization, the property gradient is determined as described hereinabove, that is, as any percentage point difference in degree of neutralization. However, where the property gradient relates to hardness, modulus, or melt flow, the property gradient may be measured as any % difference in the property within a treated region of the golf ball component. For example, where the "property" is hardness, and a treated region has a hardness of "A" at depth $D_1$ and a hardness of "B" at Depth $D_2$ then that treated region has an internal gradient of $((A-B)/A))\times 100\%$ wherein A is the highest number. This is equally applicable for each property other than neutralization.

The term "external property gradient", as applied to neutralization, is synonymous with "external neutralization gradient". However, the term "external property gradient", for hardness, modulus and melt flow with respect to a center, refers to any % difference in hardness, modulus or melt flow between the geometric center of an innermost region and the surface of an outermost region of the center, wherein at least an outermost region is treated. Meanwhile, he term "external property gradient", for hardness, modulus and melt flow with respect to a golf ball layer, refers to any % difference in hardness, modulus or melt flow between the surfaces of either two treated regions within the golf ball layer or a treated region and an untreated region within the golf ball layer. For example, where a golf ball comprises a treated center having an outer treated region and an inner untreated region, and the geometric center hardness is B and the center outer surface has a hardness A, then the external property gradient is $((A-B)/A))\times 100\%$.

Golf balls of the invention may be made having regions comprising any neutralization, hardness, modulus, and melt flow value possible/known in the art at a particular depth, depending on the desired golf ball characteristics. Neutralization, hardness, modulus, and melt flow and test methods for determining each are discussed in the detailed description herein below.

The invention also relates to a method of making a golf ball comprising: providing a core, optionally forming at least one intermediate layer about the core, forming a cover layer about the core or the at least one intermediate layer, wherein at least one of the core, the at least one intermediate layer, and the cover comprises at least one of an ionomer and an acid copolymer, is treated with an organometallic composition, and farms a treated golf ball component having at least one treated region wherein the at least one treated region comprises a reaction product of the organometallic composition and the at least one ionomer and/or acid copolymer; the at least one treated region having an internal neutralization gradient; or at least two treated regions, in tandem, having an external neutralization gradient; or the at least one treated region and an untreated region, in tandem, have an external neutralization gradient; and (a) where the treated golf ball component comprises a center, the treated region is formed before forming any of the intermediate layer and cover layer about the center; and (b) where the treated golf ball component is a golf ball layer comprising at least one of an outer core layer, an intermediate layer, an inner cover layer and an outer cover layer, (i) an inner treated region of the golf ball layer is formed before forming the golf ball layer about the core or an inner layer, and (ii) an outer treated region of the golf ball layer is formed either before or after forming the golf ball layer about the core or the inner layer.

In another embodiment, the method of making a golf ball comprises: providing a core, optionally forming at least one intermediate layer about the core, forming a cover layer about the core or the at least one intermediate layer, wherein at least one of the core, the at least one intermediate layer, and the cover comprises at least one of an ionomer and an acid copolymer, is treated with an organometallic composition, and forms a treated golf ball component having at least one treated region wherein the at least one treated region comprises a reaction product of the organometallic composition and the at least one ionomer and/or acid copolymer; the at least one treated region having an internal property gradient; or at least two treated regions, in tandem, having an external property gradient; or the at least one treated region and an untreated region, in tandem, have an external property gradient; and (a) where the treated golf ball component comprises a center, the treated region is formed before forming any of the intermediate layer and cover layer about the center; and (b) where the treated golf ball component is a golf ball layer comprising at least one of an outer core layer, an intermediate layer, an inner cover layer and an outer cover layer, (i) an inner treated region of the golf ball layer is formed before forming the golf ball layer about the core or an inner layer, and (ii) an outer treated region of the golf ball layer is formed either before or after forming the golf ball layer about the core or the inner layer.

In yet another embodiment, the method of making a golf ball comprises: providing a core, optionally forming at least one intermediate layer about the core, forming a cover layer about the core or the at least one intermediate layer, wherein at least one of the core, the at least one intermediate layer, and the cover comprises a treated golf ball component comprising at least one of an ionomer and an acid copolymer and having at least two regions, wherein at least one region is a treated region comprising a reaction product of an organometallic composition and the at least one ionomer and/or acid copolymer; such that at least one of a hardness, a modulus and a melt flow of the at least two regions is different; and (a) where the treated golf ball component comprises a center, the treated region is formed before forming any of the intermediate layer and cover layer about the center; and (b) where the treated golf ball component is a golf ball layer comprising at least one of an outer core layer, an intermediate layer, an inner cover layer and an outer cover layer, (i) an inner treated region of the golf ball layer is formed before forming the golf ball layer about the core or an inner layer, and (ii) an outer treated region of the golf ball layer is formed either before or after forming the golf ball layer about the core or the inner layer.

A method of making a golf ball according to the invention may include the following steps without limiting their order: choosing the component to be treated, selecting the at least one organometallic compound for treating the component; selecting at least one suitable solvent for preparing the organometallic composition; determining a concentration of the at least one organometallic compound in the solvent; choosing a method of treatment (e.g., spraying, soaking, dipping, etc.); choosing treatment time(s) and temperature(s); choosing drying method, drying time and drying temperature.

Further embodiments of the golf ball of the invention are envisioned which may be achieved by replacing the word "comprising" herein with either the word "consisting essentially of" or "consisting of".

DETAILED DESCRIPTION

Figure 1A:
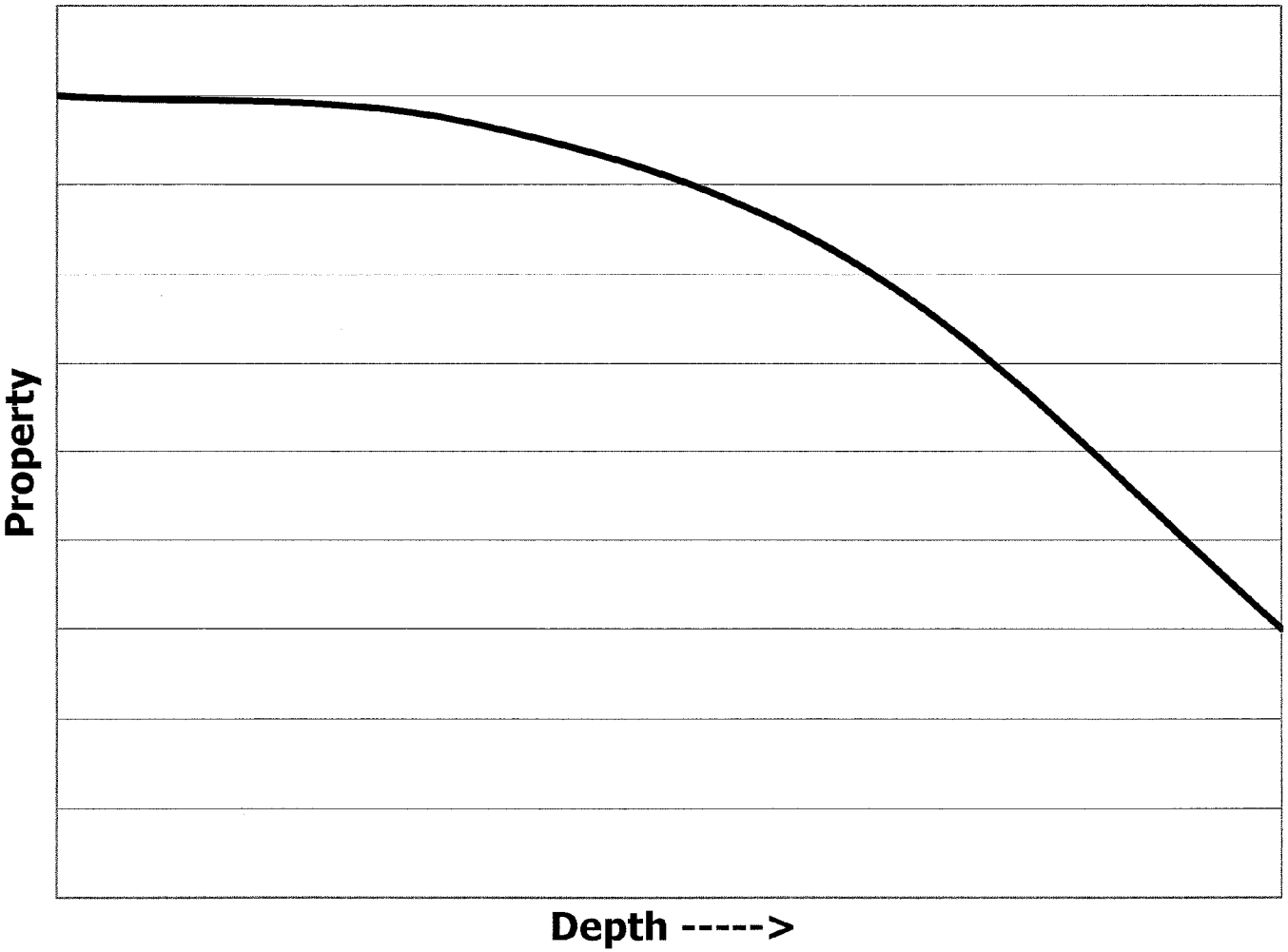
FIG. 1A is a graph depicting the percent neutralization, hardness, or modulus ("property") as a function of depth for single golf ball component having a treated region being treated with at least one alkyl metal composition and comprising a reaction product of an ionomer and/or acid copolymer and the organometallic composition according to one embodiment of the golf ball of the invention.
Figure 1B:
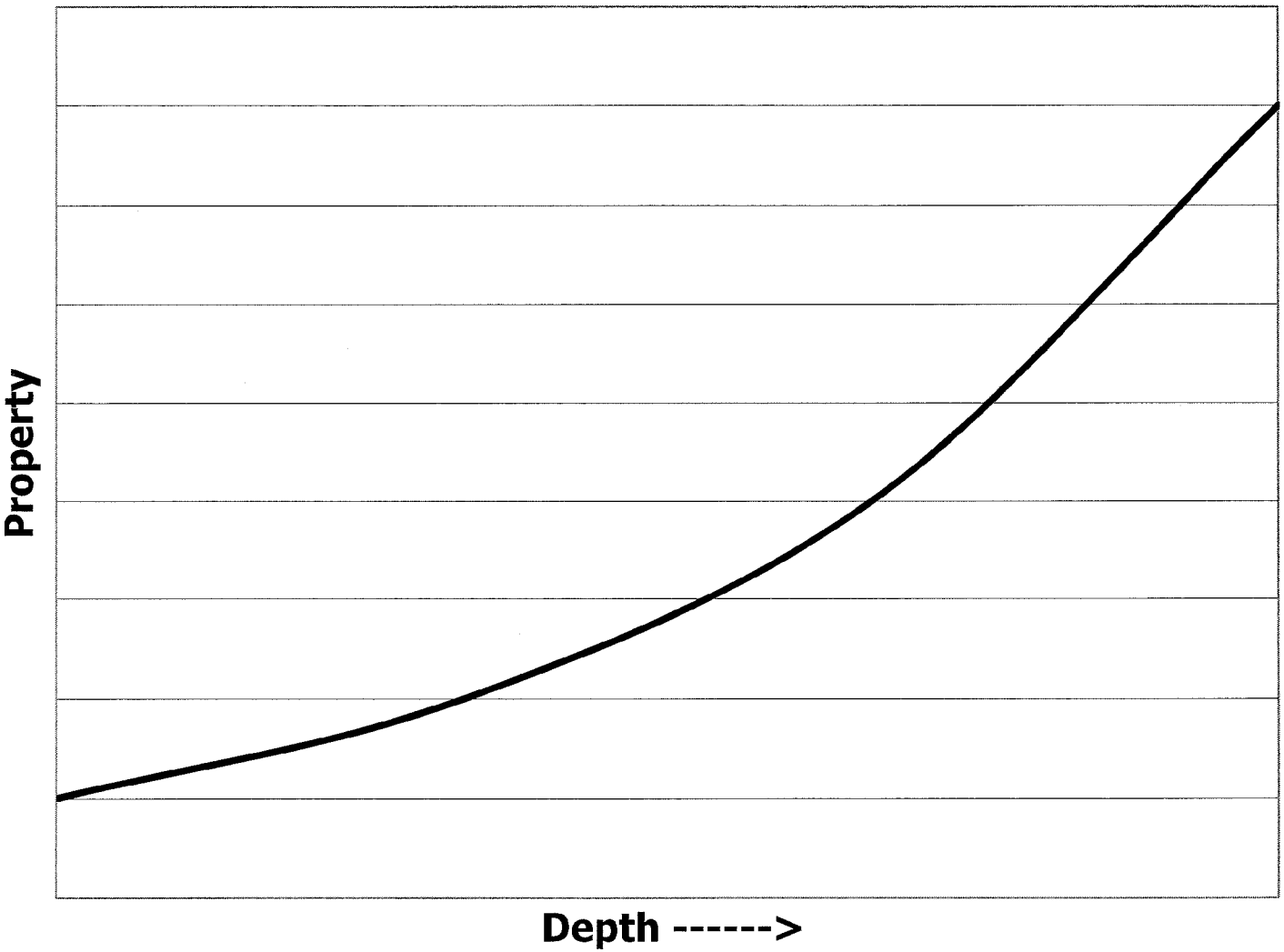
FIG. 1B is a graph depicting the melt flow ("property") as a function of depth for single golf ball component having a treated region being treated with at least one organometallic composition and comprising a reaction product of an ionomer and/or acid copolymer and the organometallic composition according to the same embodiment of the golf ball of the invention as depicted in FIG. 1A.
Figure 2A:
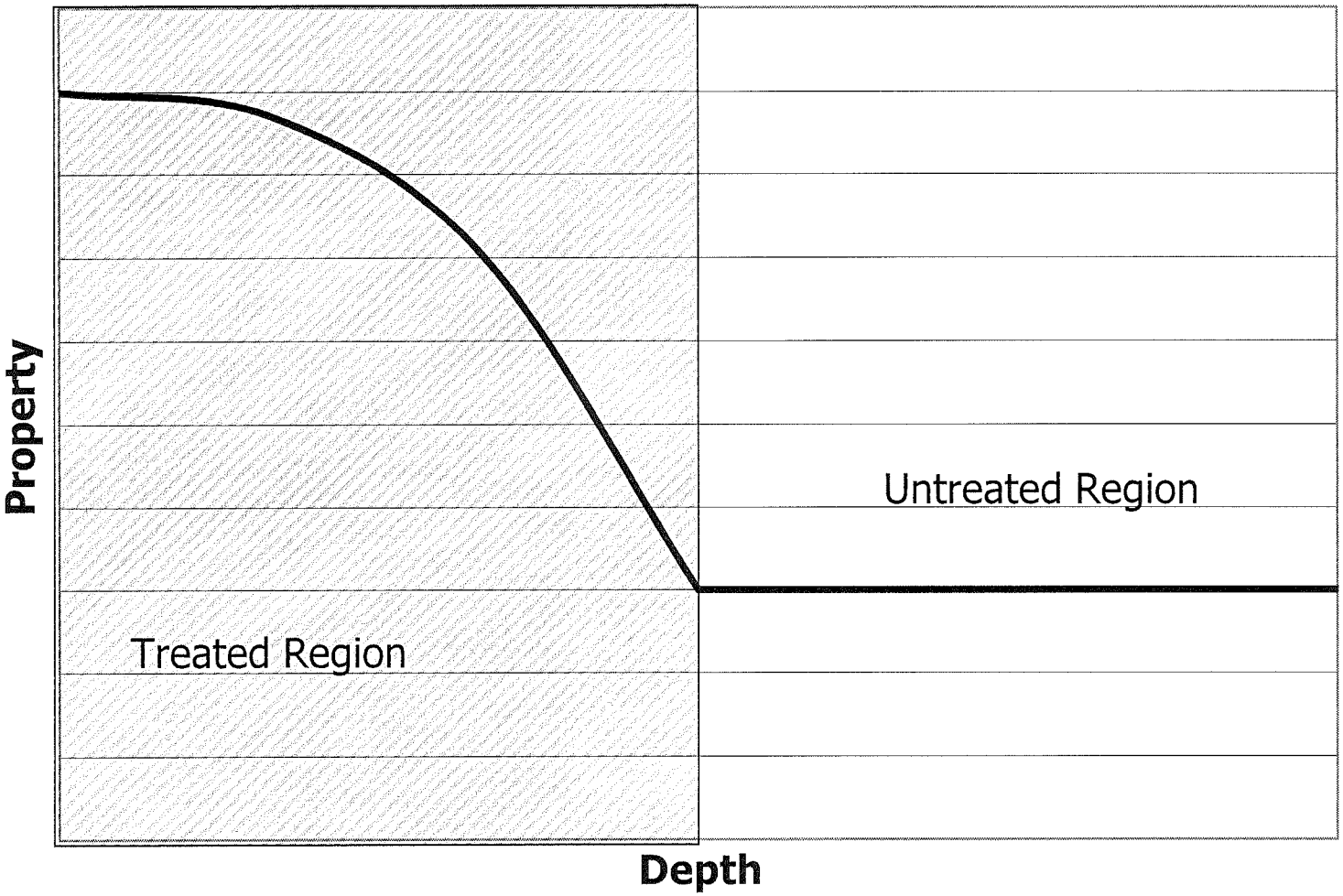
FIG. 2A is a graph depicting the percent neutralization, hardness, or modulus ("property") as a function of depth for single golf ball component having a treated region and an untreated region, the treated region being treated with at least one organometallic composition and comprising a reaction product of an ionomer and/or acid copolymer and the organometallic composition according to another embodiment of the golf ball of the invention.
Figure 2B:
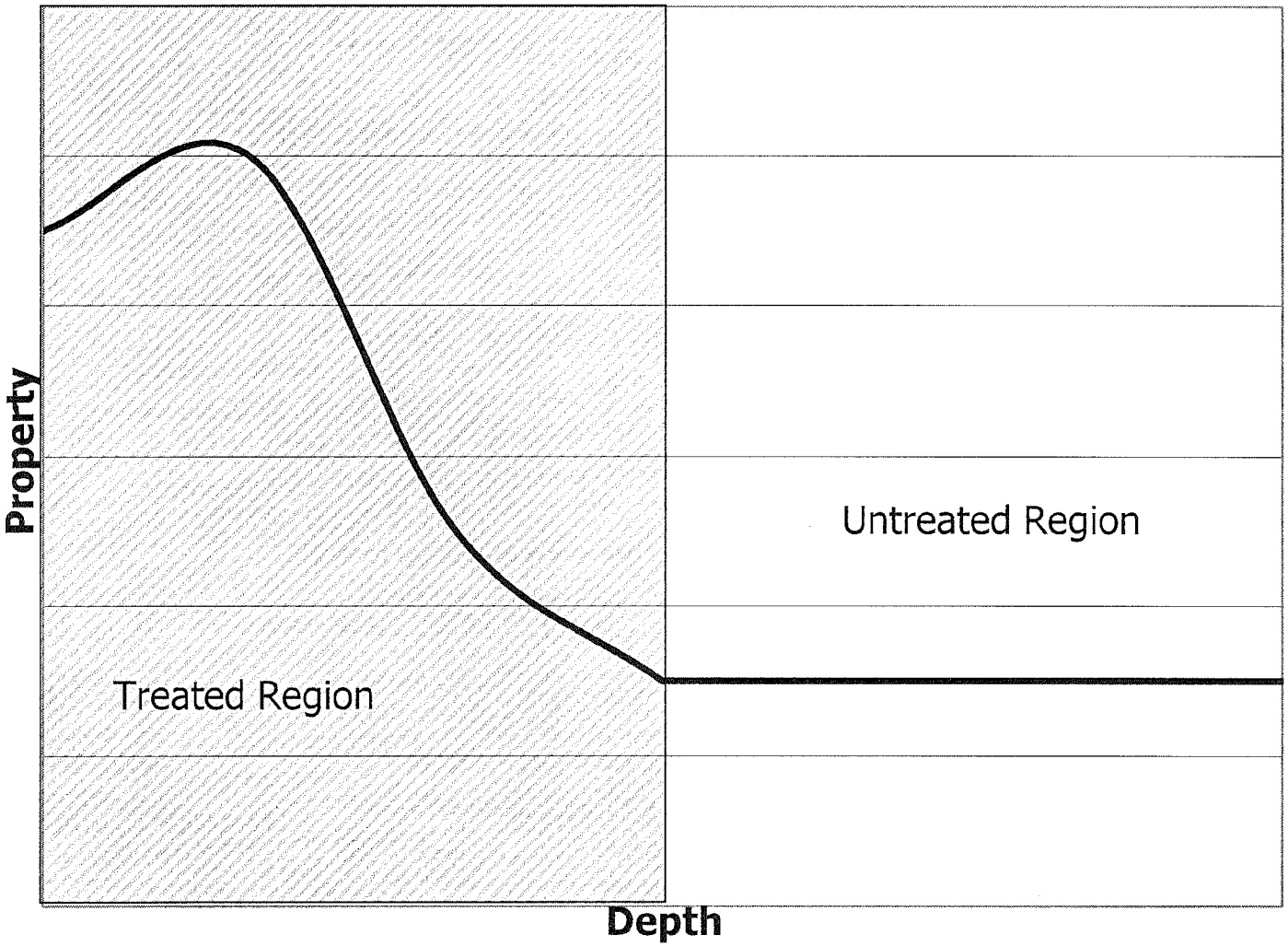
FIG. 2B is a graph depicting the percent neutralization, hardness, or modulus ("property") as a function of depth for single golf ball component having a treated region and an untreated region, the treated region being treated with at least one organometallic composition and comprising a reaction product of an ionomer and/or acid copolymer and the organometallic composition according to a variation of the embodiment of the golf ball of the invention depicted in FIG. 2A.
Figure 2C:
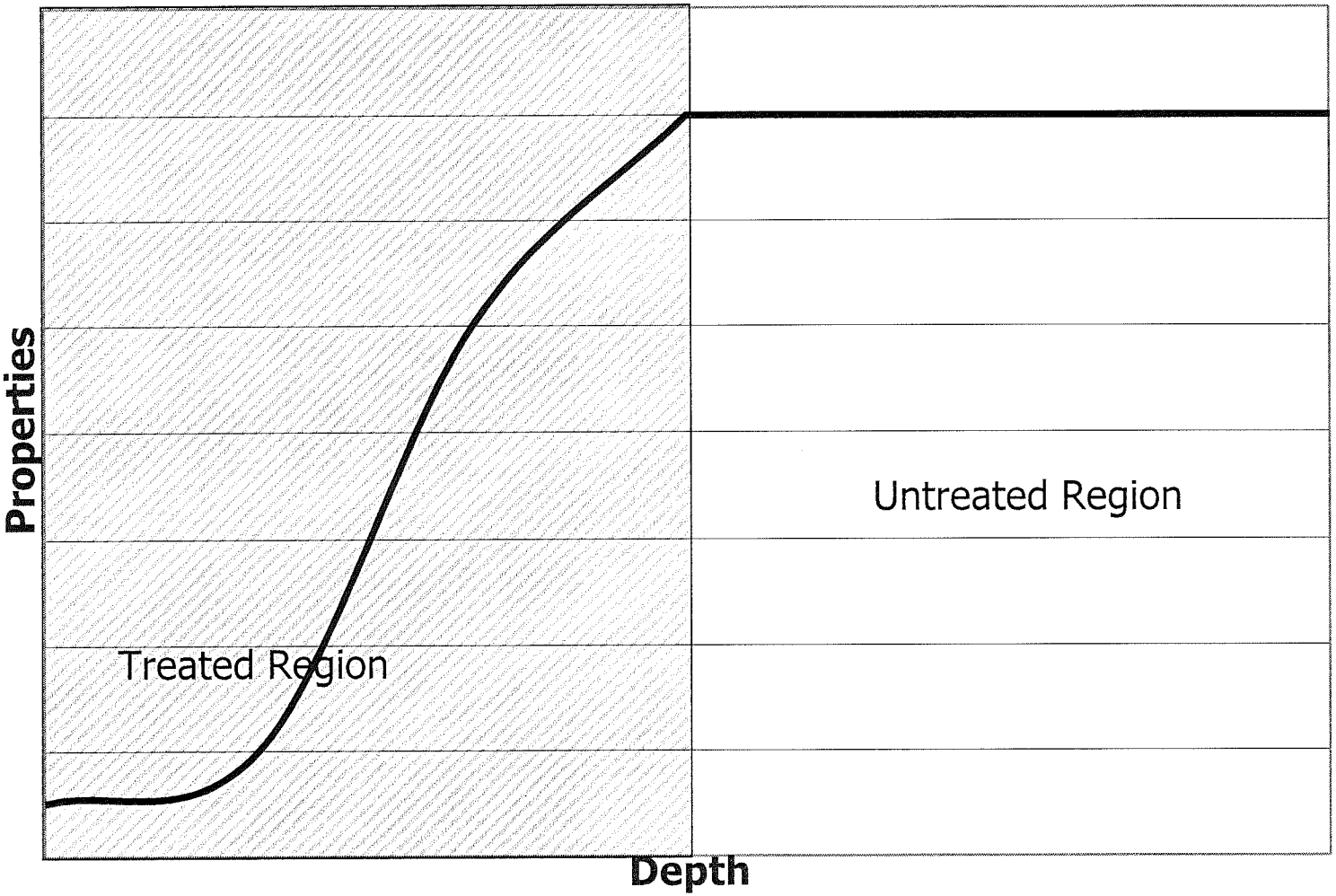
FIG. 2C is a graph depicting the melt flow ("property") as a function of depth for single golf ball component having a treated region and an untreated region, the treated region being treated with at least one organometallic composition and comprising a reaction product of an ionomer and/or acid copolymer and the organometallic composition which might be achieved according to either of the embodiments depicted in FIG. 2A or FIG. 2B.
Figure 3A:
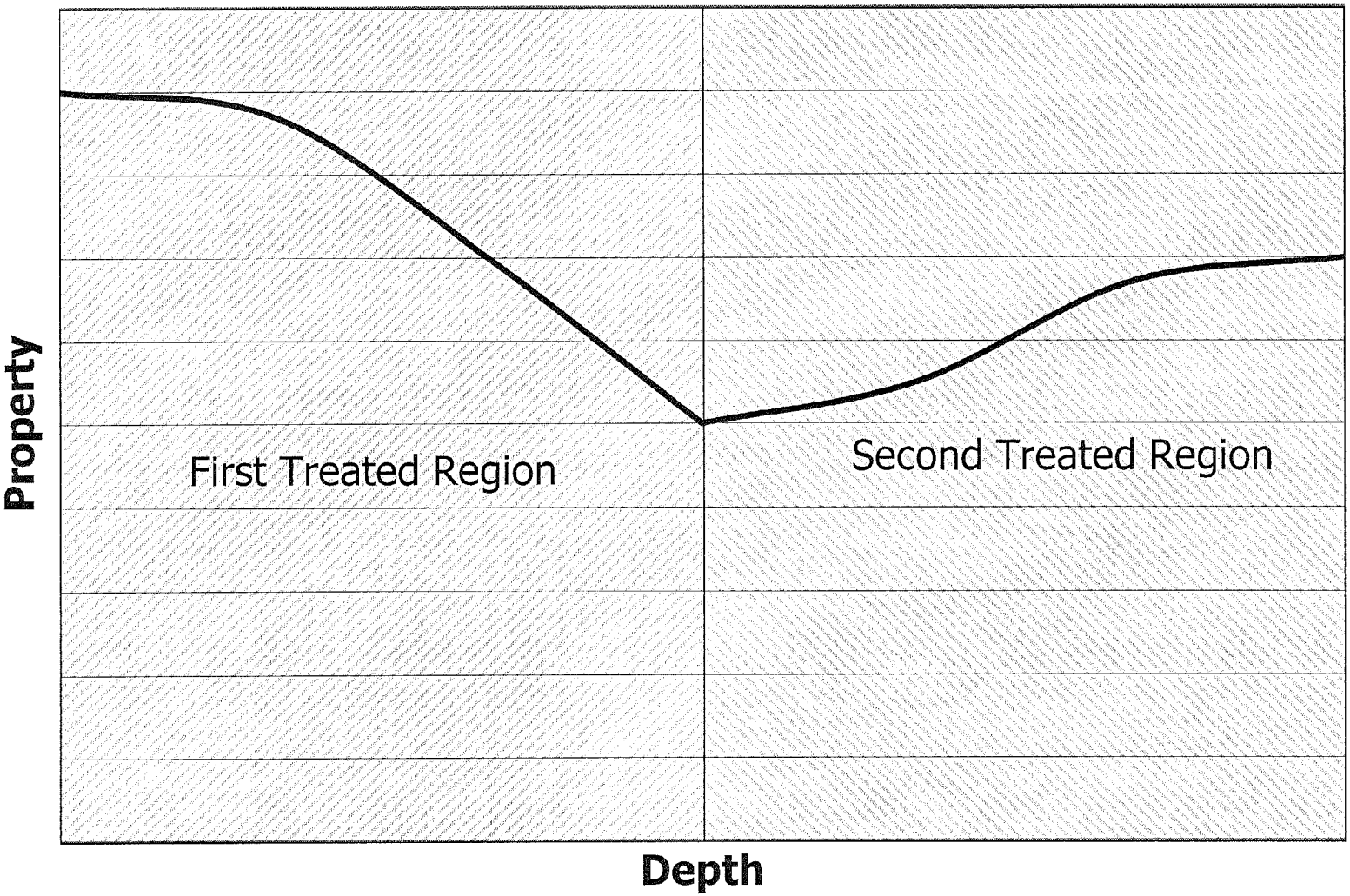
FIG. 3A is a graph depicting the percent neutralization, hardness, or modulus ("property") as a function of depth for single golf ball component having two treated regions each treated region being treated with at least one organometallic composition and comprising a reaction product of an ionomer and/or acid copolymer and the organometallic composition according to yet another embodiment of the golf ball of the invention.
Figure 3B:
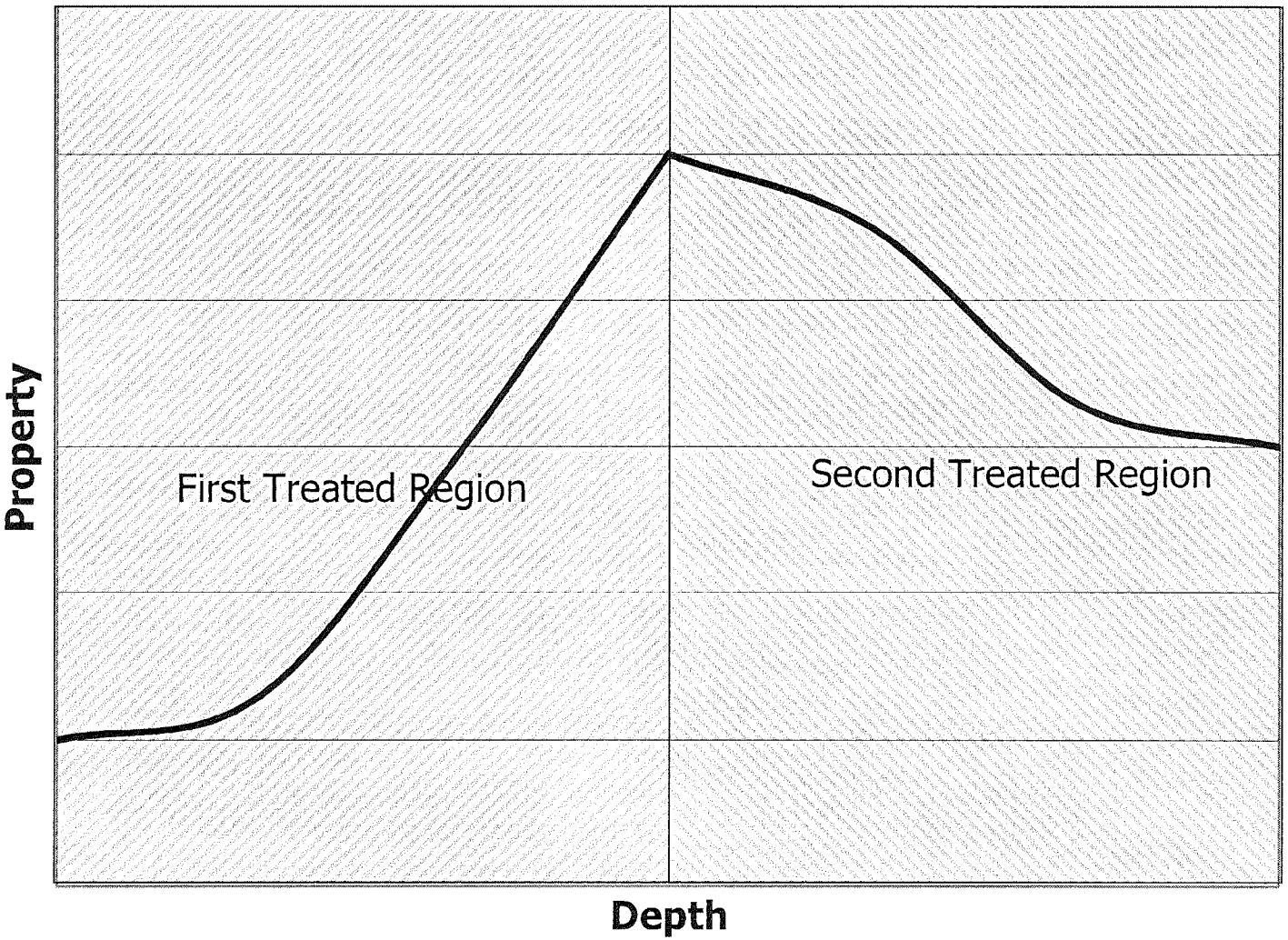
FIG. 3B is a graph depicting the melt flow as a function of depth for single golf ball component having two treated regions each treated region being treated with at least one organometallic composition and comprising a reaction product of an ionomer and/or acid copolymer and the organometallic composition according to the embodiment of the golf ball of the invention also depicted in FIG. 3A.
Figure 4A:
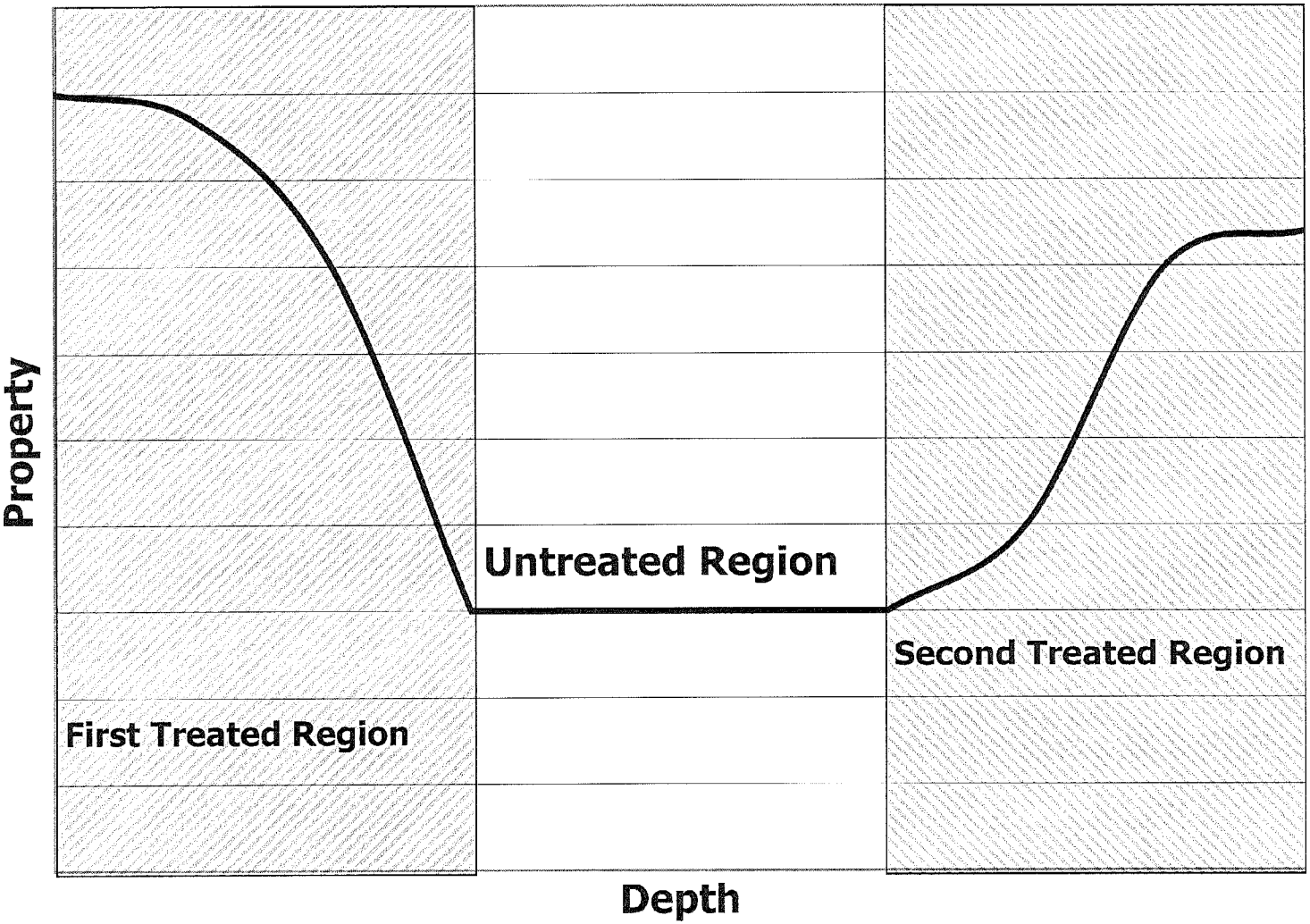
FIG. 4A is a graph depicting the percent neutralization, hardness, or modulus ("property") as a function of depth for single golf ball component having two treated regions and an untreated region, the treated regions being treated with at least one organometallic composition and comprising a reaction product of an ionomer and/or acid copolymer and the organometallic composition according to still another embodiment of the golf ball of the invention.
Figure 4B:
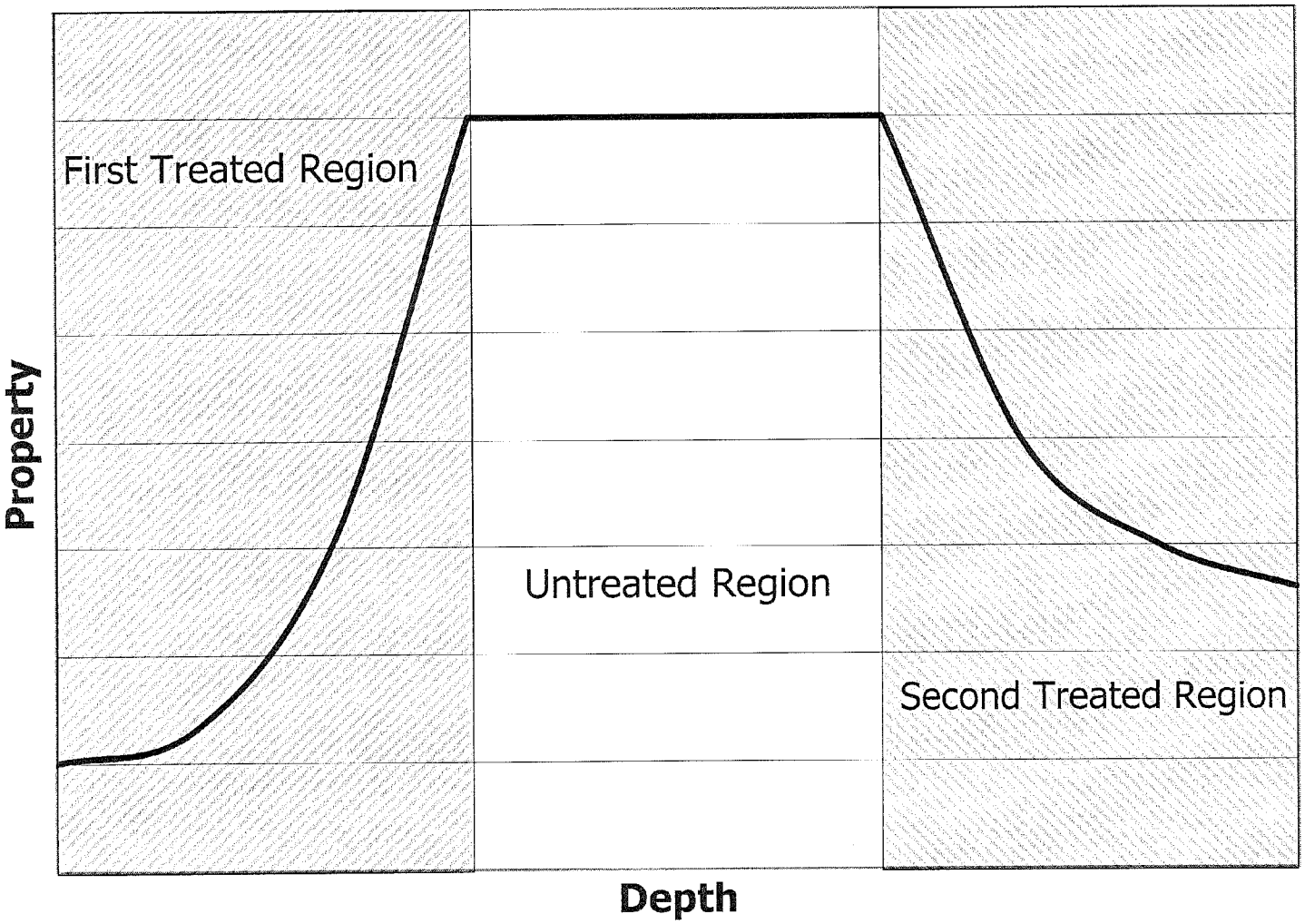
FIG. 4B is a graph depicting the melt flow ("property") as a function of depth for single golf ball component having two treated regions and an untreated region, the treated regions being treated with at least one organometallic composition and comprising a reaction product of an ionomer and/or acid copolymer and the organometallic composition according to the embodiment of the golf ball of the invention also depicted in FIG. 4A.
Figure 5:
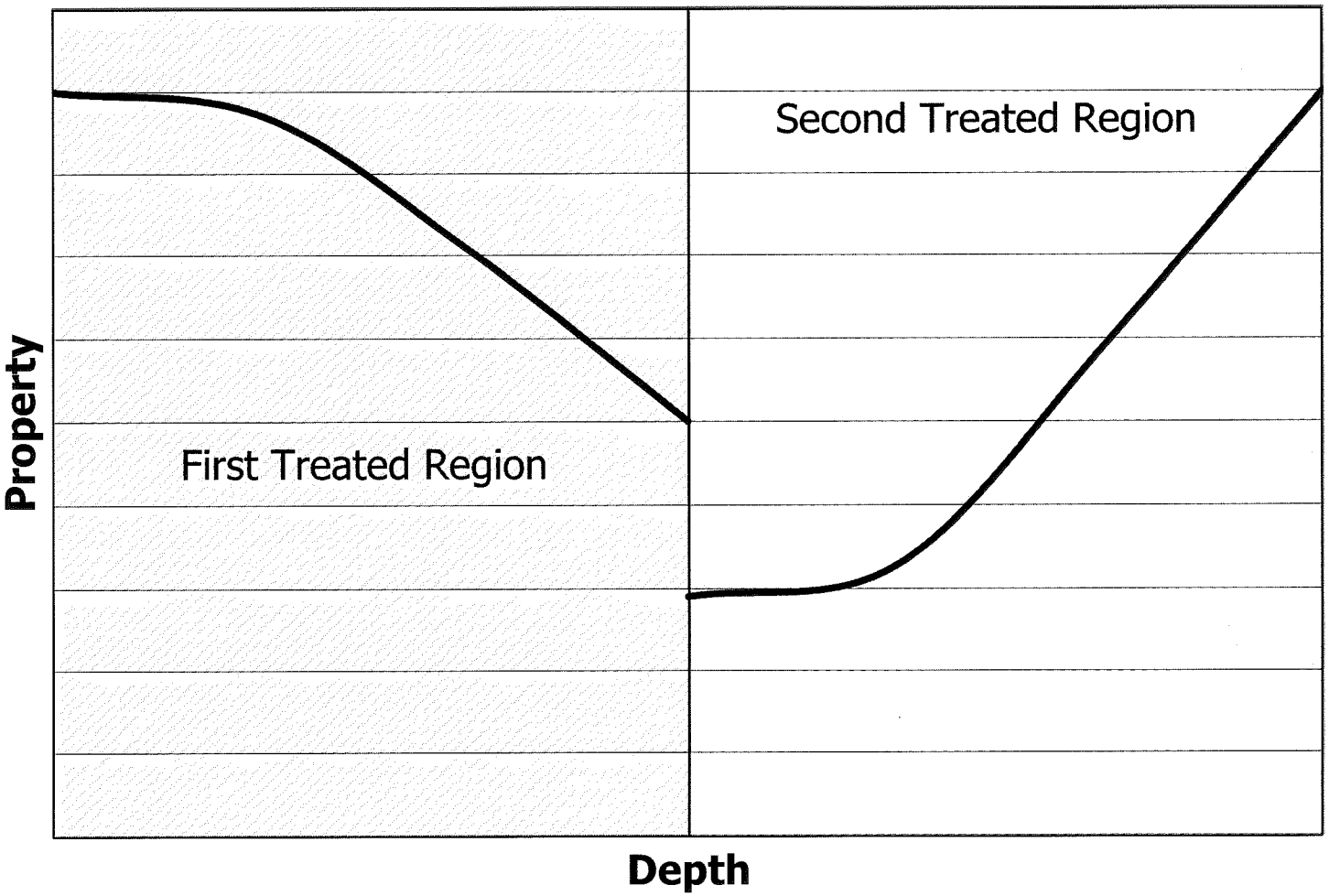
FIG. 5 is a graph depicting the percent neutralization, hardness, or modulus ("property") as a function of depth for single golf ball component having two treated regions, each being treated with at least one organometallic composition and comprising a reaction product of an ionomer and/or acid copolymer and the organometallic composition according to a further embodiment of the golf ball of the invention wherein internal gradients are formed while no external gradient is formed.
Figure 6:
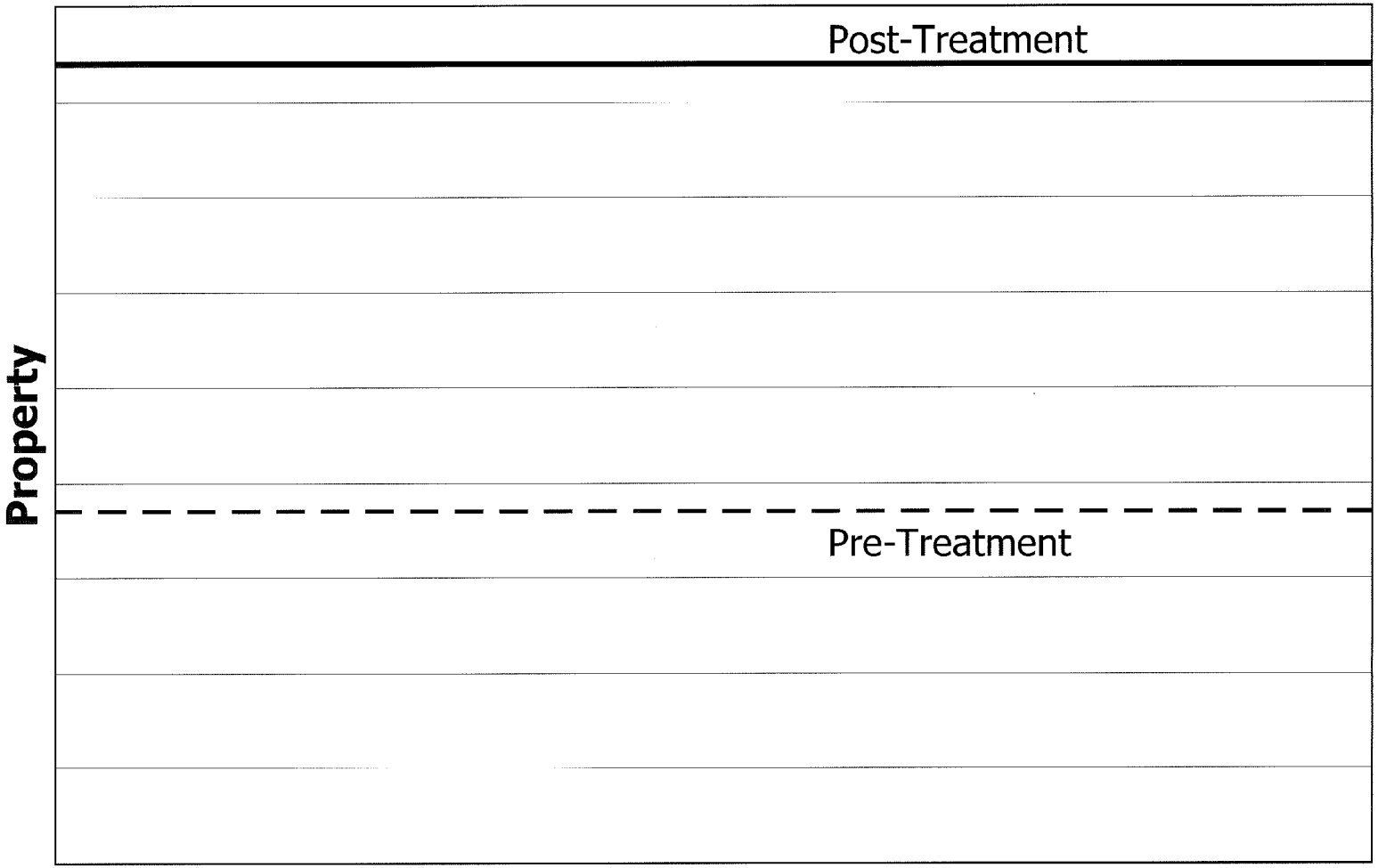
FIG. 6 is a graph depicting melt flow ("property") as a function of depth for single golf ball component before and after treatment wherein the entire component depth is treated with at least one organometallic composition and comprising a reaction product of an ionomer and/or acid copolymer and the organometallic composition according to yet another embodiment of the golf ball of the invention.
Figure 7A:
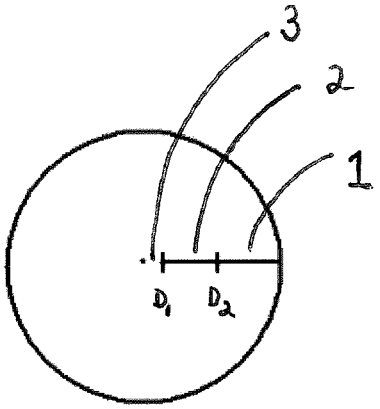
FIGS. 7A, 7B and 7C depict several embodiments of centers that have been treated multiple times with an organometallic composition and comprise a reaction product of an ionomer and/or acid copolymer and the organometallic composition according to one embodiment of the golf ball of the invention.
Figure 7B:
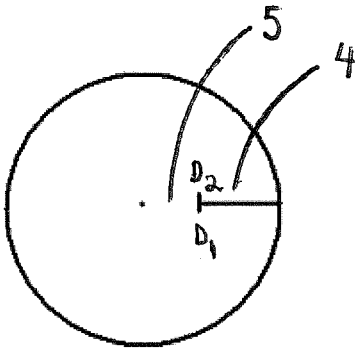
Figure 7C:
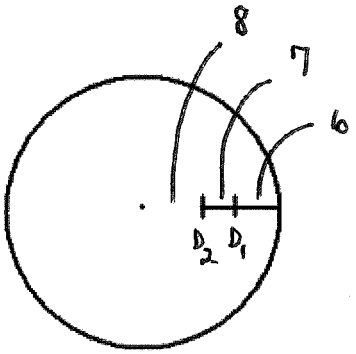
Figure 8:
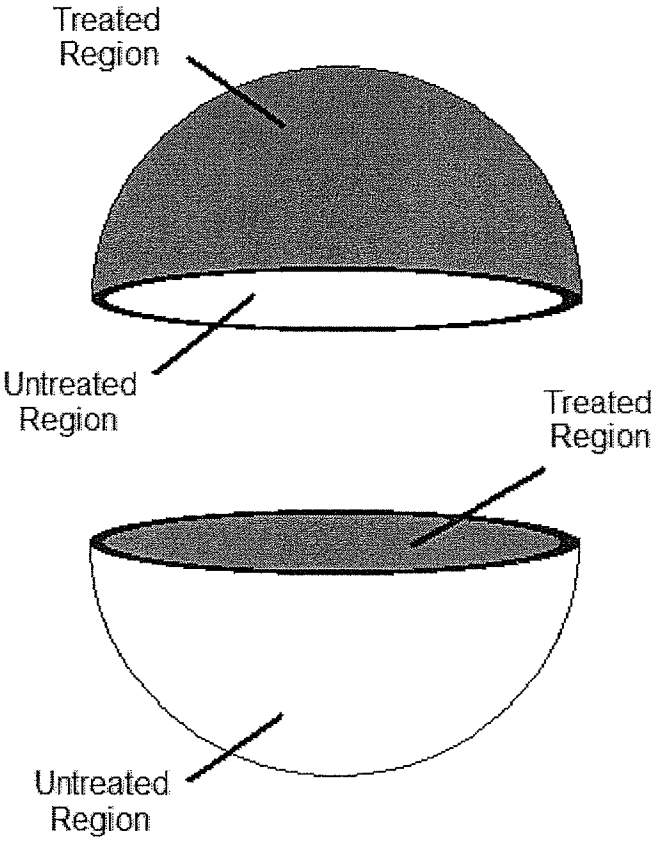
FIG. 8 depicts two golf ball half-shells having an untreated region and a treated region, the treated regions being treated with organometallic compositions and comprising a reaction product of an ionomer and/or acid copolymer and the organometallic composition according to one embodiment of the golf ball of the invention.
Figure 9:
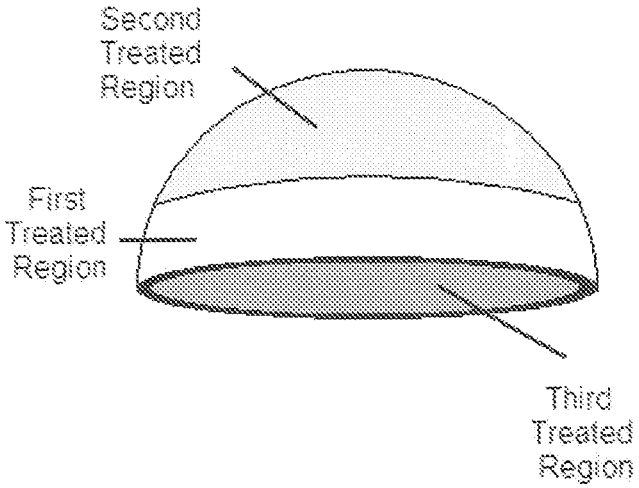
FIG. 9 depicts a golf ball half-shell comprising an ionomer and/or acid copolymer and having three treated regions, one treated region on the inside of the half-shell having been treated with at least one organometallic composition and comprising a reaction product of the ionomer and/or acid copolymer and the organometallic composition, and two treated regions on the outside of the half shell, the outside having been treated twice, each time with a different organometallic composition and comprising a reaction product of the ionomer and/or acid copolymer and the organometallic composition.

The cores in golf balls of this invention may be solid, semi-solid, hollow, fluid-filled, or powder-filled. Typically, the cores are solid and made from rubber compositions containing at least a base rubber, free-radical initiator agent, cross-linking co-agent, and fillers. Golf balls having various constructions may be made in accordance with this invention. For example, golf balls having three-piece, four-piece, and five-piece constructions with dual or three-layered cores and cover materials may be made. More particularly, in one version, a three-piece golf ball comprising a center and a "dual-cover" is made. In another version, a four-piece golf ball comprising a dual-core and "dual-cover" is made. The dual-core includes an inner core (center) and surrounding outer core layer. The dual-cover includes inner cover and outer cover layers. In yet another construction, a five-piece golf ball having a dual-core, intermediate layer, and dual-cover is made. In still another embodiment, a four piece golf ball comprises a core and a three layer cover.

As used herein, the term, "intermediate layer" means a layer of the golf ball disposed between the core (center or outer core layer) and cover. The intermediate layer may be considered an outer core layer, or inner cover layer, or any other layer disposed between the inner core and outer cover of the ball. The diameter and thickness of the different layers along with properties such as hardness and compression may vary depending upon the construction and desired playing performance properties of the golf ball and as specified herein.

The inner core of the golf ball may comprise a polybutadiene rubber material. In one embodiment, the ball contains a single core formed of the polybutadiene rubber composition. In a second embodiment, the ball contains a dual-core comprising an inner core (center) and surrounding outer core layer. In yet another version, the golf ball contains a multi-layered core comprising an inner core, intermediate core layer, and outer core layer.

In general, polybutadiene is a homopolymer of 1,3-butadiene. Any suitable catalyst may be used to synthesize the polybutadiene rubber depending upon the desired properties. Normally, a transition metal complex (for example nickel, or cobalt), a rare earth metal such as neodymium or an alkyl metal such as alkyllithium is used as a catalyst. Other catalysts include, but are not limited to, aluminum, boron, lithium, titanium, and combinations thereof. The catalysts produce polybutadiene rubbers having different chemical structures. In a cis-bond configuration, the main internal polymer chain of the polybutadiene appears on the same side of the carbon-carbon double bond contained in the polybutadiene. In a trans-bond configuration, the main internal polymer chain is on opposite sides of the internal carbon-carbon double bond in the polybutadiene. The polybutadiene rubber can have various combinations of cis- and trans-bond structures. A preferred polybutadiene rubber has a 1, 4 cis-bond content of at least 40%, preferably greater than 80%, and more preferably greater than 90%. In general, highly crosslinked polybutadiene rubbers having a high 1, 4 cis-bond content have high tensile strength. The polybutadiene rubber may have a relatively high or low Mooney viscosity.

Examples of commercially available polybutadiene base rubbers that can be used in accordance with this invention, include, but are not limited to, BR 01 and BR 1220, available from BST Elastomers of Bangkok, Thailand; SE BR 1220LA and SE BR1203, available from DOW Chemical Co of Midland, Mich.; BUDENE 1207, 1207s, 1208, and 1280 available from Goodyear, Inc of Akron, Ohio; BR 01, 51 and 730, available from Japan Synthetic Rubber (JSR) of Tokyo, Japan; BUNA CB 21, CB 22, CB 23, CB 24, CB 25, CB 29 MES, CB 60, CB Nd 60, CB 55 NF, CB 70 B, CB KA 8967, and CB 1221, available from Lanxess Corp. of Pittsburgh.

Pa.; BR1208, available from LG Chemical of Seoul, South Korea; UBEPOL BR130B, BR150, BR150B, BR150L, BR230, BR360L, BR710, and VCR617, available from UBE Industries, Ltd. of Tokyo, Japan; EUROPRENE NEOCIS BR 60, INTENE 60 AF and P30AF, and EUROPRENE BR HV80, available from Polimeri Europa of Rome, Italy; AFDENE 50 and NEODENE BR40, BR45, BR50 and BR60, available from Karbochem (PTY) Ltd. of Bruma, South Africa; KBR 01, NdBr 40, NdBR-45, NdBr 60, KBR 710S, KBR 710H, and KBR 750, available from Kumho Petrochemical Co., Ltd. Of Seoul, South Korea; DIENE 55NF, 70AC, and 320 AC, available from Firestone Polymers of Akron, Ohio; and PBR-Nd Group II and Group III, available from Nizhnekamskneftekhim, Inc. of Nizhnekamsk, Tartarstan Republic.

Other suitable polybutadiene base rubbers include BUNA® CB22, BUNA® CB23 and BUNA® CB24, BUNA® 1203G1, 1220, 1221, and BUNA® CBNd-40, commercially available from LANXESS Corporation; BSTE BR-1220 available from BST Elastomers Co. LTD; UBEPOL® 360L and UBEPOL® 150L and UBEPOL-BR rubbers, commercially available from UBE Industries, Ltd. of Tokyo, Japan; Budene 1207, 1208 and 1280, commercially available from Goodyear of Akron, Ohio; SE BR-1220, commercially available from Dow Chemical Company; Europrene® NEOCIS® BR 40 and BR 60, commercially available from Polimeri Europa; and BR 01, BR 730, BR 735, BR 11, and BR 51, commercially available from Japan Synthetic Rubber Co., Ltd; and NEODENE 40, 45, and 60, commercially available from Karbochem.

Still other suitable base rubbers may include polyisoprene rubber, natural rubber, ethylene-propylene rubber, ethylene-propylene diene rubber, styrene-butadiene rubber, and combinations of two or more thereof. Another preferred base rubber is polybutadiene optionally mixed with one or more elastomers such as polyisoprene rubber, natural rubber, ethylene propylene rubber, ethylene propylene diene rubber, styrene-butadiene rubber, polystyrene elastomers, polyethylene elastomers, polyurethane elastomers, polyurea elastomers, acrylate rubbers, polyoctenamers, metallocene-catalyzed elastomers, and plastomers. As discussed further below, highly neutralized acid copolymers (HNPs), as known in the art, also can be used to form the core layer as part of the blend. Such compositions will provide increased flexural modulus and toughness thereby improving the golf ball's performance including its impact durability.

The base rubbers may be blended with each other and typically may be mixed with at least one reactive cross-linking co-agent to enhance the hardness of the rubber composition. Suitable co-agents include, but are not limited to, unsaturated carboxylic acids and unsaturated vinyl compounds. A preferred unsaturated vinyl compound is trimethylolpropane trimethacrylate. The rubber composition is cured using a conventional curing process. Suitable curing processes include, for example, peroxide curing, sulfur curing, high-energy radiation, and combinations thereof. In one embodiment, the base rubber is peroxide cured. Organic peroxides suitable as free-radical initiators include, for example, dicumyl peroxide; n-butyl-4,4-di(t-butylperoxy)valerate; 1,1-di(t-butylperoxy)3,3,5-trimethylcyclohexane; 2,5-dimethyl-2,5-di(t-butylperoxy)hexane; di-t-butyl peroxide; di-t-amyl peroxide; t-butyl peroxide; t-butyl cumyl peroxide; 2,5-dimethyl-2,5-di(t-butylperoxy)hexyne-3; di(2-t-butylperoxyisopropyl)benzene; dilauroyl peroxide; dibenzoyl peroxide; t-butyl hydroperoxide; and combinations thereof. Cross-linking co-agents are used to cross-link at least a portion of the polymer chains in the composition. Suitable cross-linking co-agents include, for example, metal salts of unsaturated carboxylic acids having from 3 to 8 carbon atoms; unsaturated vinyl compounds and polyfunctional monomers (for example, trimethylolpropane trimethacrylate); phenylene bismaleimide; and combinations thereof. In a particular embodiment, the cross-linking co-agent is selected from zinc salts of acrylates, diacrylates, methacrylates, and dimethacrylates. In another particular embodiment, the cross-linking co-agent is zinc diacrylate ("ZDA"). Commercially available zinc diacrylates include those selected from Cray Valley or Resource Innovations Inc. Other elastomers known in the art may also be added, such as other polybutadiene rubbers, natural rubber, styrene butadiene rubber, and/or isoprene rubber in order to further modify the properties of the core. When a mixture of elastomers is used, the amounts of other constituents in the core composition are typically based on 100 parts by weight of the total elastomer mixture.

Thermoplastic elastomers (TPE) may also be used to modify the properties of the core layers, or the uncured core layer stock by blending with the uncured rubber. These TPEs include natural or synthetic balata, or high trans-polyisoprene, high trans-polybutadiene, or any styrenic block copolymer, such as styrene ethylene butadiene styrene, styrene-isoprene-styrene, etc., a metallocene or other single-site catalyzed polyolefin such as ethylene-octene, or ethylene-butene, or thermoplastic polyurethanes (TPU), including copolymers, e.g. with silicone. Other suitable TPEs for blending with the thermoset rubbers of the present invention include PEBAX®, which is believed to comprise polyether amide copolymers, HYTREL®, which is believed to comprise polyether ester copolymers, thermoplastic urethane, and KRATON®, which is believed to comprise styrenic block copolymer elastomers. Any of the TPEs or TPUs above may also contain functionality suitable for grafting, including maleic acid or maleic anhydride. Any of the Thermoplastic Vulcanized Rubbers (TPV) such as Santoprene® or Vibram® or ETPV® can be used along with a present invention. In one embodiment, the TPV has a thermoplastic as a continuous phase and a cross-linked rubber particulate as a dispersed (or discontinuous) phase. In another embodiment, the TPV has a cross-linked phase as a continuous phase and a thermoplastic as a dispersed (or discontinuous) phase to provide reduced loss in elasticity in order to improve the resiliency of the golf ball.

The rubber compositions also may contain "soft and fast" agents such as a halogenated organosulfur, organic disulfide, or inorganic disulfide compounds. Particularly suitable halogenated organosulfur compounds include, but are not limited to, halogenated thiophenols. Preferred organic sulfur compounds include, but not limited to, pentachlorothiophenol ("PCTP") and a salt of PCTP. A preferred salt of PCTP is ZnPCTP. A suitable PCTP is sold by the Struktol Company (Stow, Ohio) under the tradename, A95. ZnPCTP is commercially available from EchinaChem (San Francisco, Calif.). These compounds also may function as cis-to-trans catalysts to convert some cis bonds in the polybutadiene to trans bonds. Antioxidants also may be added to the rubber compositions to prevent the breakdown of the elastomers. Other ingredients such as accelerators (for example, tetramethylthiuram sulfides), processing aids, dyes and pigments, wetting agents, surfactants, plasticizers, as well as other additives known in the art may be added to the rubber composition.

The core may be formed by mixing and forming the rubber composition using conventional techniques. These cores can be used to make finished golf balls by surrounding the core with outer core layer(s), intermediate layer(s), and/or cover materials as discussed further below. In another embodiment, the cores can be formed using highly neutralized polymer (HNP) compositions as disclosed in U.S. Pat. Nos. 6,756,436, 7,030,192, 7,402,629, and 7,517,289. The cores from the highly neutralized polymer compositions can be further cross-linked using any free-radical initiation sources including radiation sources such as gamma or electron beam as well as chemical sources such as peroxides and the like.

Golf balls made in accordance with this invention can be of any size, although the USGA requires that golf balls used in competition have a diameter of at least 1.68 inches and a weight of no greater than 1.62 ounces. For play outside of USGA competition, the golf balls can have smaller diameters and be heavier.

A wide variety of thermoplastic or thermosetting materials can be employed in fanning the center, core layer(s), intermediate layer(s), and/or cover layer(s). These materials include for example, grafted polyolefins such as Fusabond®525D or olefin-based copolymer ionomer resins for example, Surlyn® ionomer resins and DuPont® HPF 1000 and HPF 2000, as well as blends of Surlyn®7940/Surlyn®8940 or Surlyn®8150/Surlyn®9150, all commercially available from E. I. du Pont de Nemours and Company; Iotek® ionomers, commercially available from ExxonMobil Chemical Company; Amplify® IO ionomers of ethylene acrylic acid copolymers, commercially available from The Dow Chemical Company; and Clarix® ionomer resins, commercially available from A. Schulman Inc.; polyurethanes; polyureas; copolymers and hybrids of polyurethane and polyurea; polyethylene, including, for example, low density polyethylene, linear low density polyethylene, and high density polyethylene; polypropylene; rubber-toughened olefin polymers; acid polymers, for example, poly(meth)acrylic acid, which do not become part of an ionomeric copolymer; plastomers; flexomers; styrene-butadiene-styrene block copolymers; styrene-ethylene-butylene-styrene block copolymers; dynamically vulcanized elastomers; copolymers of ethylene and vinyl acetates; copolymers of ethylene and methyl acrylates; polyvinyl chloride resins; polyamides, poly(amide-ester) elastomers, and graft copolymers of ionomer and polyimide including, for example, Pebax® thermoplastic polyether block amides, commercially available from Arkema Inc; cross-linked trans-polyisoprene and blends thereof; polyester-based thermoplastic elastomers, such as Hytrel®, commercially available from E. I. du Pont de Nemours and Company; polyurethane-based thermoplastic elastomers, such as Elastollan®, commercially available from BASF; synthetic or natural vulcanized rubber; and combinations thereof.

In fact, any of the core, intermediate layer and/or cover layers may include the following materials:

(1) Polyurethanes, such as those prepared from polyols and diisocyanates or polyisocyanates and/or their prepolymers;

(2) Polyureas; and (3) Polyurethane-urea hybrids, blends or copolymers comprising urethane and urea segments.

Suitable polyurethane compositions comprise a reaction product of at least one polyisocyanate and at least one curing agent. The curing agent can include, for example, one or more polyamines, one or more polyols, or a combination thereof. The polyisocyanate can be combined with one or more polyols to form a prepolymer, which is then combined with the at least one curing agent. Thus, the polyols described herein are suitable for use in one or both components of the polyurethane material, i.e., as part of a prepolymer and in the curing agent. Suitable polyurethanes are described in U.S. Patent Application Publication No. 2005/0176523, which is incorporated by reference in its entirety.

Any polyisocyanate available to one of ordinary skill in the art is suitable for use according to the invention. Exemplary polyisocyanates include, but are not limited to, 4,4'-diphenylmethane diisocyanate (MDI); polymeric MDI; carbodiimide-modified liquid MDI; 4,4'-dicyclohexylmethane diisocyanate ($H_{12}$MDI); p-phenylene diisocyanate (PPDI); m-phenylene diisocyanate (MPDI); toluene diisocyanate (TDI); 3,3'-dimethyl-4,4'-biphenylene diisocyanate; isophoronediisocyanate; 1,6-hexamethylene diisocyanate (HDI); naphthalene diisocyanate; xylene diisocyanate; p-tetramethylxylene diisocyanate; m-tetramethylxylene diisocyanate; ethylene diisocyanate; propylene-1,2-diisocyanate; tetramethylene-1,4-diisocyanate; cyclohexyl diisocyanate; dodecane-1,12-diisocyanate; cyclobutane-1,3-diisocyanate; cyclohexane-1,3-diisocyanate; cyclohexane-1,4-diisocyanate; 1-isocyanato-3,3,5-trimethyl-5-isocyanatomethylcyclohexane; methyl cyclohexylene diisocyanate; triisocyanate of HDI; triisocyanate of 2,4,4-trimethyl-1,6-hexane diisocyanate; tetracene diisocyanate; napthalene diisocyanate; anthracene diisocyanate; isocyanurate of toluene diisocyanate; uretdione of hexamethylene diisocyanate; and mixtures thereof. Polyisocyanates are known to those of ordinary skill in the art as having more than one isocyanate group, e.g., di-isocyanate, tri-isocyanate, and tetra-isocyanate. Preferably, the polyisocyanate includes MDI, PPDI, TDI, or a mixture thereof, and more preferably, the polyisocyanate includes MDI. It should be understood that, as used herein, the term MDI includes 4,4'-diphenylmethane diisocyanate, polymeric MDI, carbodiimide-modified liquid MDI, and mixtures thereof. Additionally, the prepolymers synthesized from these diisocyanates may be "low free monomer," understood by one of ordinary skill in the art to have lower levels of "free" isocyanate monomers, typically less than about 0.1% free isocyanate. Examples of "low free monomer" prepolymers include, but are not limited to Low Free Monomer MDI prepolymers, Low Free Monomer TDI prepolymers, and Low Free Monomer PPDI prepolymers.

Any polyol available to one of ordinary skill in the art is suitable for use according to the invention. Exemplary polyols include, but are not limited to, polyether polyols, hydroxy-terminated polybutadiene (including partially/fully hydrogenated derivatives), polyester polyols, polycaprolactone polyols, and polycarbonate polyols. In one preferred embodiment, the polyol includes polyether polyol. Examples include, but are not limited to, polytetramethylene ether glycol (PTMEG), polyethylene propylene glycol, polyoxypropylene glycol, and mixtures thereof. The hydrocarbon chain can have saturated or unsaturated bonds and substituted or unsubstituted aromatic and cyclic groups. Preferably, the polyol of the present invention includes PTMEG.

In another embodiment, polyester polyols are included in the polyurethane material. Suitable polyester polyols include, but are not limited to, polyethylene adipate glycol; polybutylene adipate glycol; polyethylene propylene adipate glycol; o-phthalate-1,6-hexanediol; poly(hexamethylene adipate) glycol; and mixtures thereof. The hydrocarbon chain can have saturated or unsaturated bonds, or substituted or unsubstituted aromatic and cyclic groups.

In another embodiment, polycaprolactone polyols are included in the materials of the invention. Suitable polycaprolactone polyols include, but are not limited to, 1,6-hexanediol-initiated polycaprolactone, diethylene glycol initiated polycaprolactone, trimethylol propane initiated polycaprolactone, neopentyl glycol initiated polycaprolactone, 1,4-butanediol-initiated polycaprolactone, and mixtures thereof. The hydrocarbon chain can have saturated or unsaturated bonds, or substituted or unsubstituted aromatic and cyclic groups.

In yet another embodiment, polycarbonate polyols are included in the polyurethane material of the invention. Suitable polycarbonates include, but are not limited to, polyphthalate carbonate and poly(hexamethylene carbonate) glycol. The hydrocarbon chain can have saturated or unsaturated bonds, or substituted or unsubstituted aromatic and cyclic groups. In one embodiment, the molecular weight of the polyol is from about 200 to about 4000.

Polyamine curatives are also suitable for use in the polyurethane composition of the invention and have been found to improve cut, shear, and impact resistance of the resultant balls. Preferred polyamine curatives include, but are not limited to, 3,5-dimethylthio-2,4-toluenediamine and isomers thereof; 3,5-diethyltoluene-2,4-diamine and isomers thereof, such as 3,5-diethyltoluene-2,6-diamine; 4,4'-bis-(sec-butylamino)-diphenylmethane; 1,4-bis-(sec-butylamino)-benzene, 4,4'-methylene-bis-(2-chloroaniline); 4,4'-methylene-bis-(3-chloro-2,6-diethylaniline); polytetramethyleneoxide-di-p-aminobenzoate; N,N'-dialkyldiamino diphenyl methane; p,p'-methylene dianiline; m-phenylenediamine; 4,4'-methylene-bis-(2-chloroaniline); 4,4'-methylene-bis-(2,6-diethylaniline); 4,4'-methylene-bis-(2,3-dichloroaniline); 4,4'-diamino-3,3'-diethyl-5,5'-dimethyl diphenylmethane; 2,2',3,3'-tetrachloro diamino diphenylmethane; trimethylene glycol di-p-aminobenzoate; and mixtures thereof. Preferably, the curing agent of the present invention includes 3,5-dimethylthio-2,4-toluenediamine and isomers thereof, such as ETHACURE® 300, commercially available from Albermarle Corporation of Baton Rouge, La. Suitable polyamine curatives, which include both primary and secondary amines, preferably have molecular weights ranging from about 64 to about 2000.

At least one of a diol, triol, tetraol, or hydroxy-terminated curatives may be added to the aforementioned polyurethane composition. Suitable diol, triol, and tetraol groups include ethylene glycol; diethylene glycol; polyethylene glycol; propylene glycol; polypropylene glycol; lower molecular weight polytetramethylene ether glycol; 1,3-bis(2-hydroxyethoxy) benzene; 1,3-bis-[2-(2-hydroxyethoxy)ethoxy]benzene; 1,3-bis-{2-[2-(2-hydroxyethoxy)ethoxy]ethoxy}benzene; 1,4-butanediol; 1,5-pentanediol; 1,6-hexanediol; resorcinol-di-(β-hydroxyethyl)ether; hydroquinone-di-(β-hydroxyethyl) ether; and mixtures thereof. Preferred hydroxy-terminated curatives include 1,3-bis(2-hydroxyethoxy)benzene; 1,3-bis-[2-(2-hydroxyethoxy)ethoxy]benzene; 1,3-bis-{2-[2-(2-hydroxyethoxy)ethoxy]ethoxy}benzene; 1,4-butanediol, and mixtures thereof. Preferably, the hydroxy-terminated curatives have molecular weights ranging from about 48 to 2000. It should be understood that molecular weight, as used herein, is the absolute weight average molecular weight and would be understood as such by one of ordinary skill in the art.

Both the hydroxy-terminated and amine curatives can include one or more saturated, unsaturated, aromatic, and cyclic groups. Additionally, the hydroxy-terminated and amine curatives can include one or more halogen groups. The polyurethane composition can be fon led with a blend or mixture of curing agents. If desired, however, the polyurethane composition may be formed with a single curing agent.

In one embodiment of the present invention, saturated polyurethanes are used to foul'. one or more of the cover layers.

Additionally, polyurethane can be replaced with or blended with a polyurea material.

The polyether amine may be blended with additional polyols to formulate copolymers that are reacted with excess isocyanate to form a prepolymer. In one embodiment, less than about 30 percent polyol by weight of the copolymer is blended with the saturated polyether amine. In another embodiment, less than about 20 percent polyol by weight of the copolymer, preferably less than about 15 percent by weight of the copolymer, is blended with the polyether amine. The polyols listed above with respect to the polyurethane prepolymer, e.g., polyether polyols, polycaprolactone polyols, polyester polyols, polycarbonate polyols, hydrocarbon polyols, other polyols, and mixtures thereof, are also suitable for blending with the polyether amine. The molecular weight of these polymers may be from about 200 to about 4000, but also may be from about 1000 to about 3000, and more preferably are from about 1500 to about 2500.

The polyurea composition can be formed by crosslinking a polyurea prepolymer with a single curing agent or a blend of curing agents. In one embodiment, the amine-terminated curing agent may have a molecular weight of about 64 or greater. In another embodiment, the molecular weight of the amine-curing agent is about 2000 or less. As discussed above, certain amine-terminated curing agents may be modified with a compatible amine-terminated freezing point depressing agent or mixture of compatible freezing point depressing agents Suitable amine-terminated curing agents include, but are not limited to, ethylene diamine; hexamethylene diamine; 1-methyl-2,6-cyclohexyl diamine; tetrahydroxypropylene ethylene diamine; 2,2,4- and 2,4,4-trimethyl-1,6-hexanediamine; 4,4'-bis-(sec-butylamino)-dicyclohexylmethane; 1,4-bis-(sec-butylamino)-cyclohexane; 1,2-bis-(sec-butylamino)-cyclohexane; derivatives of 4,4'-bis-(sec-butylamino)-dicyclohexylmethane; 4,4'-dicyclohexylmethane diamine; 1,4-cyclohexane-bis-(methylamine); 1,3-cyclohexane-bis-(methylamine); diethylene glycol di-(aminopropyl)ether; 2-methylpentamethylene-diamine; diaminocyclohexane; diethylene triamine; triethylene tetramine; tetraethylene pentamine; propylene diamine; 1,3-diaminopropane; dimethylamino propylamine; diethylamino propylamine; dipropylene triamine; imido-bis-propylamine; monoethanolamine, diethanolamine; 3,5-diethyltoluene-2,4-diamine; triethanolamine; monoisopropanolamine, diisopropanolamine; isophoronediamine; 4,4'-methylenebis-(2-chloroaniline); 3,5-dimethylthio-2,4-toluenediamine; 3,5-dimethylthio-2,6-toluenediamine; 3,5-diethylthio-2,4-toluenediamine; 3,5-diethylthio-2,6-toluenediamine; 4,4'-bis-(sec-butylamino)-diphenylmethane and derivatives thereof; 1,4-bis-(sec-butylamino)-benzene; 1,2-bis-(sec-butylamino)-benzene; N,N'-dialkylamino-diphenylmethane; N,N,N',N'-tetrakis(2-hydroxypropyl)ethylene diamine; trimethyleneglycol-di-p-aminobenzoate; polytetramethyleneoxide-di-p-aminobenzoate; 4,4'-methylenebis-(3-chloro-2,6-diethyleneaniline); 4,4'-methylenebis-(2,6-diethylaniline); meta-phenylenediamine; paraphenylenediamine; and mixtures thereof. In one embodiment, the amine-terminated curing agent is 4,4'-bis-(sec-butylamino)-dicyclohexylmethane.

Suitable saturated amine-terminated curing agents include, but are not limited to, ethylene diamine; hexamethylene diamine; 1-methyl-2,6-cyclohexyl diamine; tetrahydroxypropylene ethylene diamine; 2,2,4- and 2,4,4-trimethyl-1,6-hexanediamine; 4,4'-bis-(sec-butylamino)-dicyclohexylmethane; 1,4-bis-(sec-butylamino)-cyclohexane; 1,2-bis-(sec-butylamino)-cyclohexane; derivatives of 4,4'-bis-(sec-butylamino)-dicyclohexylmethane; 4,4'-dicyclohexylmethane diamine; 4,4'-methylenebis-(2,6-diethylaminocyclohexane; 1,4-cyclohexane-bis- (methylamine); 1,3-cyclohexane-bis-(methylamine); diethylene glycol di-(aminopropyl)ether; 2-methylpentamethylene-diamine; diaminocyclohexane; diethylene triamine; triethylene tetramine; tetraethylene pentamine; propylene diamine; 1,3-diaminopropane; dimethylamino propylamine; diethylamino propylamine; imido-bis-propylamine; monoethanolamine, diethanolamine; triethanolamine; monoisopropanolamine, diisopropanolamine; isophoronediamine; triisopropanolamine; and mixtures thereof. In addition, any of the polyether amines listed above may be used as curing agents to react with the polyurea prepolymers.

Alternatively, other suitable polymers include partially or fully neutralized ionomer, metallocene, or other single-site catalyzed polymer, polyester, polyamide, non-ionomeric thermoplastic elastomer, copolyether-esters, copolyether-amides, polycarbonate, polybutadiene, polyisoprene, polystryrene block copolymers (such as styrene-butadiene-styrene), styrene-ethylene-propylene-styrene, styrene-ethylene-butylene-styrene, and the like, and blends thereof.

Intermediate layers and/or cover layers may also be formed from ionomeric polymers or ionomer blends such as Surlyn 7940/8940 or Surlyn 8150/9150 or from highly-neutralized ionomers (HNP).

In one embodiment, at least one intermediate layer of the golf ball is foimed from an HNP material or a blend of HNP materials. The acid moieties of the HNP's, typically ethylene-based ionomers, are preferably neutralized greater than about 70%, more preferably greater than about 90%, and most preferably at least about 100% with a cation source. Suitable cations include for example metal cations, organic amine compounds, ammonium, and combinations thereof. The HNPs can be also be blended with a second polymer component, which, if containing an acid group(s) such as organic acids, or more preferably fatty acids, may be neutralized in a conventional manner, with a suitable cation source. The second polymer component, which may be partially or fully neutralized, preferably comprises ionomeric copolymers and terpolymers, ionomer precursors, thermoplastics, polyamides, polycarbonates, polyesters, polyurethanes, polyureas, thermoplastic elastomers, polybutadiene rubber, balata, metallocene-catalyzed polymers (grafted and non-grafted), single-site polymers, high-crystalline acid polymers, cationic ionomers, and the like. HNP polymers typically have a material hardness of between about 20 and about 80 Shore D, and a flexural modulus of between about 3,000 psi and about 200,000 psi.

In one embodiment of the present invention the HNPs are ionomers and/or their acid precursors that are preferably neutralized, either fully or partially, with sufficient amount of metal base to achieve the desired neutralization level. The acid copolymers are preferably α-olefin, such as ethylene, $C_{3-8}$ α,β-ethylenically unsaturated carboxylic acid, such as acrylic and methacrylic acid, copolymers. They may optionally contain a softening monomer, such as alkyl acrylate and alkyl methacrylate, wherein the alkyl groups have from 1 to 8 carbon atoms.

The acid copolymers can be described as E/X/Y copolymers where E is ethylene, X is an α,β-ethylenically unsaturated carboxylic acid, and Y is a softening comonomer. In a preferred embodiment, X is acrylic or methacrylic acid and Y is a $C_{1-8}$ alkyl acrylate or methacrylate ester. X is preferably present in an amount from about 1 to about 35 weight percent of the polymer, more preferably from about 5 to about 30 weight percent of the polymer, and most preferably from about 10 to about 22 weight percent of the polymer. Y is preferably present in an amount from about 0 to about 50 weight percent of the polymer, more preferably from about 5 to about 30 weight percent of the polymer, and most preferably from about 10 to about 25 weight percent of the polymer.

Specific acid-containing ethylene copolymers include, but are not limited to, ethylene/acrylic acid/n-butyl acrylate, ethylene/methacrylic acid/n-butyl acrylate, ethylene/methacrylic acid/iso-butyl acrylate, ethylene/acrylic acid/iso-butyl acrylate, ethylene/methacrylic acid/n-butyl methacrylate, ethylene/acrylic acid/methyl methacrylate, ethylene/acrylic acid/methyl acrylate, ethylene/methacrylic acid/methyl acrylate, ethylene/methacrylic acid/methyl methacrylate, and ethylene/acrylic acid/n-butyl methacrylate. Preferred acid-containing ethylene copolymers include, ethylene/methacrylic acid/n-butyl acrylate, ethylene/acrylic acid/n-butyl acrylate, ethylene/methacrylic acid/methyl acrylate, ethylene/acrylic acid/ethyl acrylate, ethylene/methacrylic acid/ethyl acrylate, and ethylene/acrylic acid/methyl acrylate copolymers. The most preferred acid-containing ethylene copolymers are, ethylene/(meth)acrylic acid/n-butyl acrylate, ethylene/(meth) acrylic acid/ethyl acrylate, and ethylene/(meth)acrylic acid/methyl acrylate copolymers.

Ionomers are typically neutralized with a metal cation, such as Li, Na, Mg, K, Ca, Al or Zn. It has been found that by adding sufficient organic acid or salt of organic acid, along with a suitable base, to the acid copolymer or ionomer, the ionomer can be neutralized, without losing processability, to a level much greater than for a metal cation alone. Preferably, the acid moieties are neutralized greater than about 80%, preferably from 90-100%, most preferably 100% without losing processability. This is accomplished by melt-blending an ethylene α,β-ethylenically unsaturated carboxylic acid copolymer, for example, with an organic acid or a salt of organic acid, and adding a sufficient amount of a cation source to increase the level of neutralization of all the acid moieties (including those in the acid copolymer and in the organic acid) to greater than 90%, (preferably greater than 100%).

The organic acids may be aliphatic, mono- or multi-functional (saturated, unsaturated, or multi-unsaturated) organic acids. Salts of these organic acids may also be employed. The salts of organic acids of the present invention include the salts of barium, lithium, sodium, zinc, bismuth, chromium, cobalt, copper, potassium, strontium, titanium, tungsten, magnesium, cesium, iron, nickel, silver, aluminum, tin, or calcium, salts of fatty acids, particularly stearic, behenic, erucic, oleic, linoelic or dimerized derivatives thereof. It is preferred that the organic acids and salts of the present invention be relatively non-migratory (they do not bloom to the surface of the polymer under ambient temperatures) and non-volatile (they do not volatilize at temperatures required for melt-blending).

The ionomers may also be more conventional ionomers, i.e., partially-neutralized with metal cations. The acid moiety in the acid copolymer is neutralized about 1 to about 90%, preferably at least about 20 to about 75%, and more preferably at least about 40 to about 70%, to form an ionomer, by a cation such as lithium, sodium, potassium, magnesium, calcium, barium, lead, tin, zinc, aluminum, or a mixture thereof.

The golf ball may also contain additives, ingredients, and other materials in amounts that do not detract from the properties of the final composition. These additive materials include, but are not limited to, activators such as calcium or magnesium oxide; fatty acids such as stearic acid and salts thereof; fillers and reinforcing agents such as organic or inorganic particles, for example, clays, talc, calcium, magnesium carbonate, silica, aluminum silicates, zeolites, powdered metals, and organic or inorganic fibers, plasticizers such as dialkyl esters of dicarboxylic acids; surfactants; softeners; tackifiers; waxes; ultraviolet (UV) light absorbers and stabilizers; antioxidants; optical brighteners; whitening agents such as titanium dioxide and zinc oxide; dyes and pigments; processing aids; release agents; and wetting agents. These compositions provide improved melt processability, and a balance of ball performance.

Blowing/foaming agents may also be compatible with and be included in golf balls of the invention, including, for example those disclosed in U.S. Pat. No. 7,708,654. Typical physical foaming/blowing agents include volatile liquids such as freons (CFCs), other halogenated hydrocarbons, water, aliphatic hydrocarbons, gases, and solid blowing agents, i.e., compounds that liberate gas as a result of desorption of gas. Preferably, the blowing agent includes an adsorbent. Typical adsorbents include, for example, activated carbon, calcium carbonate, diatomaceous earth, and silicates saturated with carbon dioxide.

Chemical foaming/blowing agents may be incorporated. Chemical blowing agents may be inorganic, such as ammonium carbonate and carbonates of alkalai metals, or may be organic, such as azo and diazo compounds, such as nitrogen-based azo compounds. Suitable azo compounds include, but are not limited to, 2,2'-azobis(2-cyanobutane), 2,2'-azobis (methylbutyronitrile), azodicarbonamide, p,p'-oxybis(benzene sulfonyl hydrazide), p-toluene sulfonyl semicarbazide, p-toluene sulfonyl hydrazide. Other blowing agents include any of the Celogens®, sold by Crompton Chemical Corporation, and nitroso compounds, sulfonylhydrazides, azides of organic acids and their analogs, triazines, tri- and tetrazole derivatives, sulfonyl semicarbazides, urea derivatives, guanidine derivatives, and esters such as alkoxyboroxines. Other possible blowing agents include agents that liberate gasses as a result of chemical interaction between components such as mixtures of acids and metals, mixtures of organic acids and inorganic carbonates, mixtures of nitriles and ammonium salts, and the hydrolytic decomposition of urea.

Alternatively, low specific gravity can be achieved by incorporating low density fillers or agents such as hollow fillers or microspheres in the polymeric matrix, where the cured composition has the preferred specific gravity. Moreover, the polymeric matrix can be foamed to decrease its specific gravity, microballoon, or other low density fillers as described in U.S. Pat. No. 6,692,380 ("'380 patent"). The '380 patent is incorporated by reference in its entirety.

Blends including non-ionomeric and olefin-based ionomeric polymers may also be incorporated to form a golf ball layer. Examples of non-ionomeric polymers include vinyl resins, polyolefins including those produced using a single-site catalyst or a metallocene catalyst, polyurethanes, polyureas, polyamides, polyphenylenes, polycarbonates, polyesters, polyacrylates, engineering thermoplastics, and the like. Also, in one embodiment of the invention, processability of the golf ball of the invention may even be enhanced by incorporating in the core a metallocene-catalyzed polybutadiene.

Olefin-based ionomers, such as ethylene-based copolymers, are often made from an unsaturated carboxylic acid, such as methacrylic acid, acrylic acid, or maleic acid. Other possible carboxylic acid groups include, for example, crotonic, maleic, fumaric, and itaconic acid. "Low acid" and "high acid" olefin-based ionomers, as well as blends of such ionomers, may be used. In general, low acid ionomers are considered to be those containing 16 wt. % or less of carboxylic acid, whereas high acid ionomers are considered to be those containing greater than 16 wt. % of carboxylic acid. The acidic group in the olefin-based ionic copolymer is partially or totally neutralized with metal ions such as zinc, sodium, lithium, magnesium, potassium, calcium, manganese, nickel, chromium, copper, or a combination thereof. For example, ionomeric resins having carboxylic acid groups that are neutralized from about 10 percent to about 100 percent may be used. In one embodiment, the acid groups are partially neutralized. That is, the neutralization level is from 10 to 80%, more preferably 20 to 70%, and most preferably 30 to 50%. In another embodiment, the acid groups are highly or fully neutralized. Or, the neutralization level may be from about 80 to 100%, more preferably 90 to 100%, and most preferably 95 to 100%. The blend may contain about 5 to about 30% by weight of a moisture barrier composition and about 95 to about 70% by weight of a partially, highly, or fully-neutralized olefin-based ionomeric copolymer. The above-mentioned blends may contain one or more suitable compatibilizers such as glycidyl acrylate or glycidyl methacrylate or maleic anhydride containing-polymers.

The percent neutralization in a region of a layer can be determined through the use of a Fourier Transform Infrared (FTIR) Spectrophotometer with an Attenuated Total Reflectance (ATR) accessory. When used with an ATR, FTIR spectroscopy can determine the extent to which the carboxylic acid groups have been neutralized in a sample with a depth resolution up to a few microns. By comparing the FTIR peaks at the wavelengths characteristic of the unneutralized acid with a series of known standards, a good quantitation of the percent neutralization can be performed.

Additionally, the hardness and modulus or stiffness of the material, layer, or region can be measured on or off the ball at the micron or sub-micron scale through the use of a microindentation measurement instrument. These instruments typically use a load cell to measure the force required to indent a material to a measured depth of penetration with an indenter probe. Microindentation instruments can typically make multiple measurements on a layer or region directly on the golf ball, providing a direct measurement of the property gradients within a layer or region. Some examples of instruments with this capability are the Ultra-Nano, Nano, and Micro Indentation Testers available from CSM Instruments SA; the Nano and Micro Mechanical Testers available from Nanovea; the Picodenter HM500 and Fischerscope HM2000 available from Fisher Technology, and the CETR-Apex Nano/Micro Indenter, available from Bruker Corp., amongst others. Depending on the geometry of the indenter used for the measurement, the hardness may be expressed in Berkovich, Vickers, or Knoop Hardness scales, as well as others. Modulus or stiffness may be expressed in units such as psi, MPa, mN/mm, or the like. Alternately, the hardness may be expressed as a function of force applied and penetration depth.

While there is no standardized test for Melt Flow Index for very small samples, it is possible to use Atomic Force Microscopy (AFM) to conduct Scanning Thermal Microscopy (SThM) over a region to obtain 'Force-Distance' measurements at a given temperature, say 190° C., to determine the amount of deflection obtained for a given force at a given temperature. These data can be compared to give a relative measurement of the melt flow characteristic differences between a treated and untreated region, or between two or more treated regions.

In addition to the procedures identified herein, any method known in the art for measuring neutralization, hardness, modulus and melt flow of golf ball centers and layers may be used.

A golf ball of the invention may have a compression of from about 25 to about 110. In another embodiment, the overall golf ball has a compression of from about 35 to about 100. In yet another embodiment, the overall golf ball has a compression of from about 45 to about 95. In still another embodiment, the compression may be from about 55 to about 85, or from about 65 to about 75. Meanwhile, the compression may also be from about 50 to about 110, or from about 60 to about 100, or from about 70 to about 90, or even from about 80 to about 110.

Several different methods can be used to measure compression, including Atti compression, Riehle compression, load/deflection measurements at a variety of fixed loads and offsets, and effective modulus. See, e.g., *Compression by Any Other Name, Science and Golf IV, Proceedings of the World Scientific Congress of Golf* (Eric Thain ed., Routledge, 2002) ("J. Dalton") The term compression, as used herein, refers to Atti or PGA compression and is measured using an Atti compression test device. A piston compresses a ball against a spring and the piston remains fixed while deflection of the spring is measured at 1.25 mm (0.05 inches). Where a core has a very low stiffness, the compression measurement will be zero at 1.25 mm. In order to measure the compression of a core using an Atti compression tester, the core must be shimmed to a diameter of 1.680 inches because these testers are designed to measure objects having that diameter. Atti compression units can be converted to Riehle (cores), Riehle (balls), 100 kg deflection, 130-10 kg deflection or effective modulus using the formulas set forth in J. Dalton. The approximate relationship that exists between Atti or PGA compression and Riehle compression can be expressed as: (Atti or PGA compression)=(160-Riehle Compression). Thus, a Riehle compression of 100 would be the same as an Atti compression of 60.

Generally, in golf balls of the invention, the overall golf ball COR is at least about 0.780. In another embodiment, the overall golf ball COR is at least about 0.788. In yet another embodiment, the overall golf ball COR is at least about 0.791. In still another embodiment, the overall golf ball COR is at least about 0.794. Also, the overall golf ball COR may be at least about 0.797. The overall golf ball COR may even be at least about 0.800, or at least about 0.803, or at least about 0.812.

COR, as used herein, is determined by firing a golf ball or golf ball subassembly (e.g., a golf ball core) from an air cannon at two given velocities and calculating the COR at a velocity of 125 ft/s. Ball velocity is calculated as a ball approaches ballistic light screens which are located between the air cannon and a steel plate at a fixed distance. As the ball travels toward the steel plate, each light screen is activated, and the time at each light screen is measured. This provides an incoming transit time period inversely proportional to the ball's incoming velocity. The ball impacts the steel plate and rebounds through the light screens, which again measure the time period required to transit between the light screens. This provides an outgoing transit time period inversely proportional to the ball's outgoing velocity. COR is then calculated as the ratio of the outgoing transit time period to the incoming transit time period, $COR=V_{out}/V_{in}=T_{in}/T_{out}$. Preferably, a golf ball according to the present invention has a COR of at least about 0.78, more preferably, at least about 0.80.

The spin rate of a golf ball also remains an important golf ball characteristic. High spin rate allows skilled players more flexibility in stopping the ball on the green if they are able to control a high spin ball. On the other hand, recreational players often prefer a low spin ball since they do not have the ability to intentionally control the ball, and lower spin balls tend to drift less off the green.

Golf ball spin is dependent on variables including, for example, distribution of the density or specific gravity within a golf ball. For example, when the center has a higher density or specific gravity than the outer layers, a lower moment of inertia results which increases spin rate. Alternatively, when the density or specific gravity is concentrated in the outer regions of the golf ball, a higher moment of inertia results with a lower spin rate. The moment of inertia for a golf ball of the invention may be from about 0.410 oz-in$^2$ to about 0.470 oz-in$^2$. The moment of inertia for a one piece ball that is 1.62 ounces and 1.68 inches in diameter may be approximately 0.4572 oz-in$^2$, which is the baseline moment of inertia value.

Accordingly, by varying the materials and the density of the regions of each core or cover layer, different moments of inertia may be achieved for the golf ball of the present invention. In one embodiment, the resulting golf ball has a moment of inertia of from about to 0.440 to about 0.455 oz-in$^2$. In another embodiment, the golf balls of the present invention have a moment of inertia of from about 0.456 oz-in$^2$ to about 0.470 oz-in$^2$. In yet another embodiment, the golf ball has a moment of inertia of from about 0.450 oz-in$^2$ to about 0.460 oz-in$^2$.

The following prophetic examples illustrate several embodiments of golf balls according to the invention as well as the method of making such golf balls according to the invention, as compared with conventional golf balls that have not been treated with at least one organometallic composition. Tables I and II below identify the formulation for each of four examples and their respective comparative examples:

TABLE I

FORMULATIONS FOR TREATED GOLF BALL COMPONENTS ACCORDING TO THE INVENTION

| Golf Ball Component | Ex. 1 | Ex. 2 | Ex. 3 | Ex. 4 |
|---|---|---|---|---|
| Center | | | | |
| CB23[1], phr | 60 | 60 | — | 60 |
| CB1221[2], phr | 40 | 40 | | 40 |
| ZDA[3], phr | 30 | 30 | — | 30 |
| ZnPCTP[4], phr | 0.5 | 0.5 | — | 0.5 |
| ZnO, phr | 5 | 5 | — | 5 |
| DiCUP[5], phr | 0.5 | 0.5 | — | 0.5 |
| $BaSO_4$, phr | as needed | as needed | as needed | as needed |
| Cure Temp, ° F. | 340 | 340 | — | 340 |
| Cure Time, min | 11 | 11 | — | 11 |
| HPF 2000, phr | — | — | 100 | — |
| Treatment | | | | |
| Organometal | — | — | $ZnEt_2$ | — |
| Soak Temp, ° C. | — | — | 60 | — |
| Soak Time, min. | — | — | 60 | — |
| Soak Method | — | — | Dip | — |
| Part Treated | — | — | Center | — |
| Intermediate Layer 1 | | | | |
| CB23, phr | — | — | 100 | — |
| TP-301, phr | — | — | 9 | — |
| ZDA, phr | — | — | 35 | — |
| ZnPCTP, phr | — | — | 0.5 | — |
| ZnO, phr | — | — | as needed | — |
| DiCUP, phr | — | — | 0.5 | — |
| $BaSO_4$, phr | — | — | 0 | — |
| Cure Temp, ° F. | — | — | 350 | — |
| Cure Time, min | — | — | 12 | — |
| Surlyn ® 9120[7] | — | 50 | — | — |
| Surlyn ® 8150[8] | — | 50 | — | — |
| Surlyn ® 8940[8] | — | — | — | 50 |
| Surlyn ® 9910[7] | — | — | — | 50 |
| Nucrel 960[10] | 100 | — | — | — |
| Treatment 1 | | | | |
| Organometal | $ZnEt_2$ | $ZnEt_2$ | — | — |
| Soak Temp, ° C. | 25 | 60 | — | — |
| Soak Time, min. | 3 | 5 | — | — |

TABLE I-continued

FORMULATIONS FOR TREATED GOLF BALL COMPONENTS ACCORDING TO THE INVENTION

| Golf Ball Component | Ex. 1 | Ex. 2 | Ex. 3 | Ex. 4 |
|---|---|---|---|---|
| Soak Method | Spray masked cup, inner | Dip Intermed. Layer 1 | — | — |
| Part Treated | | | — | — |
| Treatment 2 | | | | |
| Organometal | n-ButylLi | — | — | — |
| Soak Temp, ° C. | 40 | — | — | — |
| Soak Time, min. | 7 | — | — | — |
| Soak Method | Dip | — | — | — |
| Part Treated | Intermed. Layer 1 | — | — | — |
| Intermediate Layer 2 | | | | |
| CB23, phr | — | 100 | — | — |
| TP-301, phr | — | 9 | — | — |
| ZDA, phr | — | 35 | — | — |
| ZnPCTP, phr | — | 0.5 | — | — |
| ZnO, phr | — | as needed | — | — |
| $BaSO_4$, phr | — | 0 | — | — |
| DiCuP, phr | — | 0.5 | — | — |
| Cure Temp, ° F. | — | 350 | — | — |
| Cure Time, min | — | 12 | — | — |
| Surlyn ® 7940 | — | — | 50 | — |
| Surlyn ® 8940 | — | — | 50 | — |
| Cover Layer | | | | |
| polyurethane | 100 | 100 | 100 | — |
| Surlyn ® 8320[8] | — | — | — | 75 |
| Surlyn ® 9650[7] | — | — | — | 25 |
| Treatment | | | | |
| Organometal | — | — | — | $ZnEt_2$ |
| Soak Temp, ° C. | — | — | — | 60 |
| Soak Time, min. | — | — | — | 5 |
| Soak Method | — | — | — | Dip |
| Part Treated | — | — | — | Cover Layer |

[1]BUNA ® CB23—high cis-polybutadiene available from Lanxess.
[2]BUNA ® CB1221—high cis-polybutadiene available from Lanxess.
[3]ZDA—Zinc diacrylate.
[4]ZnPCTP—Zinc pentachlorothiophenol.
[5]Di-Cup—Dicumyl peroxide available from Arkema.
[6]DuPont ® HPF 2000—highly neutralized ionomer available from E.I. du Pont de Nemours and Company.
[7]Surlyn ® 9650, Surlyn ® 9120 and Surlyn ® 9910—Zinc ionomer available from E.I. du Pont de Nemours and Company.
[8]Surlyn ® 8320, Surlyn ® 8150 and Surlyn ® 8940—Sodium ionomer available from E.I. du Pont de Nemours and Company.
[9]Surlyn ® 7940—Lithium ionomer available from E.I. du Pont de Nemours and Company.
[10]Nucrel ® 960—Ethylene-methacrylic acid copolymer available from E. I. du Pont de Nemours and Company.
[11]In Table I, the term "Intermed. Layer" denotes intermediate layer.

TABLE II

FORMULATIONS FOR COMPARATIVE GOLF BALLS HAVING UNTREATED COMPONENTS

| Golf Ball Component | CE1 | CE2 | CE3 | CE4 |
|---|---|---|---|---|
| Center | | | | |
| CB23, phr | 60 | 60 | — | 60 |
| CB1221, phr | 40 | 40 | | 40 |
| ZDA, phr | 30 | 30 | — | 30 |
| ZnPCTP, phr | 0.5 | 0.5 | — | 0.5 |
| ZnO, phr | 5 | 5 | — | 5 |
| DiCUP, phr | 0.5 | 0.5 | — | 0.5 |
| $BaSO_4$, phr | as needed | as needed | as needed | as needed |

TABLE II-continued

FORMULATIONS FOR COMPARATIVE GOLF BALLS HAVING UNTREATED COMPONENTS

| Golf Ball Component | CE1 | CE2 | CE3 | CE4 |
|---|---|---|---|---|
| Cure Temp, ° F. | 340 | 340 | — | 340 |
| Cure Time, min | 11 | 11 | — | 11 |
| HPF 2000, phr | — | — | 100 | — |
| Treatment | | | | |
| Organometal | — | — | — | — |
| Soak Temp, ° C. | — | — | — | — |
| Soak Time, min. | — | — | — | — |
| Soak Method | — | — | — | — |
| Part Treated | — | — | — | — |
| Intermediate Layer 1 | | | | |
| CB23, phr | — | — | 100 | — |
| TP-301, phr | — | — | 9 | — |
| ZDA, phr | — | — | 30 | — |
| ZnPCTP, phr | — | — | 0.5 | — |
| ZnO, phr | — | — | as needed | — |
| DiCUP, phr | — | — | 0.5 | — |
| $BaSO_4$, Phr | — | — | 0 | — |
| Cure Temp, ° F. | — | — | 350 | — |
| Cure Time, min | — | — | 12 | — |
| Surlyn 9120 | — | 50 | — | — |
| Surlyn 8150 | — | 50 | — | — |
| Surlyn 8940 | — | — | — | 50 |
| Surlyn 9910 | — | — | — | 50 |
| Nucrel 960 | 100 | — | — | — |
| Treatment 1 | | | | |
| Organometal | — | — | — | — |
| Soak Temp, ° C. | — | — | — | — |
| Soak Time, min. | — | — | — | — |
| Soak Method | — | — | — | — |
| Part Treated | — | — | — | — |
| Treatment 2 | | | | |
| Organometal | — | — | — | — |
| Soak Temp, ° C. | — | — | — | — |
| Soak Time, min. | — | — | — | — |
| Soak Method | — | — | — | — |
| Part Treated | — | — | — | — |
| Intermediate Layer 2 | | | | |
| CB23, phr | — | 100 | — | — |
| TP-301, phr | — | 9 | — | — |
| ZDA, phr | — | 35 | — | — |
| ZnPCTP, phr | — | 0.5 | — | — |
| ZnO, phr | — | as needed | — | — |
| $BaSO_4$, phr | — | 0 | | — |
| DiCuP, phr | — | 0.5 | — | — |
| Cure Temp, ° F. | — | 350 | — | — |
| Cure Time, min | — | 12 | — | — |
| Surlyn 7940 | — | — | 50 | — |
| Surlyn 8940 | — | — | 50 | — |
| Cover Layer | | | | |
| polyurethane | 100 | 100 | 100 | — |
| Surlyn 8320 | — | — | — | 75 |
| Surlyn 9650 | — | — | — | 25 |
| Treatment | | | | |
| Organometal | — | — | — | — |
| Soak Temp, ° C. | — | — | — | — |
| Soak Time, min. | — | — | — | — |
| Soak Method | — | — | — | — |
| Part Treated | — | — | — | — |

Table III below demonstrates that for each ionomeric center or layer treated with at least one organometallic composition, the treated layer demonstrates a gradient within the layer as compared with an identical control golf ball component that was not so treated, which did not. These results are expressed in terms of a "% Difference from the Corresponding Comparative Example". As is readily apparent from Table III, each inventive golf ball displayed at least one gradient in its treated component, while none of the comparative golf balls displayed a gradient.

TABLE III

RESULTING PROPERTIES OF TREATED GOLF BALL COMPONENTS IN EXAMPLES 1-4 VERSUS UNTREATED COMPARATIVES 1-4

Properties of the Treated Regions for Examples 1-4 Expressed as % Difference from the Corresponding Comparative Example

| | | | Example 1 Compared to CE1 | | | Example 2 Compared to CE2 | | | Example 3 Compared to CE3 | | | Example 4 Compared to CE4 | | |
|---|---|---|---|---|---|---|---|---|---|---|---|---|---|---|
| Property | Layer | Region | min | max | Sf* | min | max | Sf | min | max | Sf | min | max | Sf |
| Percent Neutralization | Center | inner | — | — | — | — | — | — | 0 | 0 | — | — | — | — |
| | | outer | — | — | — | — | — | — | 1 | 9 | 9 | — | — | — |
| | IL 1* | inner | 1 | 12 | 12 | 0 | 0 | 0 | — | — | — | — | — | — |
| | | central | 0 | 0 | 0 | — | — | — | — | — | — | — | — | — |
| | | outer | 1 | 55 | 55 | 1 | 40 | 40 | — | — | — | — | — | — |
| | IL 2 | inner | — | — | — | — | — | — | — | — | — | — | — | — |
| | | central | — | — | — | — | — | — | — | — | — | — | — | — |
| | | outer | — | — | — | — | — | — | — | — | — | — | — | — |
| | Cover | inner | — | — | — | — | — | — | — | — | — | 0 | 0 | 0 |
| | | central | — | — | — | — | — | — | — | — | — | — | — | — |
| | | outer | — | — | — | — | — | — | — | — | — | 1 | 35 | 35 |
| Micro-hardness | Center | inner | — | — | — | — | — | — | 0 | 0 | 0 | — | — | — |
| | | outer | — | — | — | — | — | — | 2 | 5 | 4 | — | — | — |
| | IL 1 | inner | 1 | 7 | 7 | 0 | 0 | 0 | — | — | — | — | — | — |
| | | central | 0 | 0 | 0 | — | — | — | — | — | — | — | — | — |
| | | outer | 1 | 25 | 25 | 1 | 8 | 8 | — | — | — | — | — | — |
| | IL 2 | inner | — | — | — | — | — | — | — | — | — | — | — | — |
| | | central | — | — | — | — | — | — | — | — | — | — | — | — |
| | | outer | — | — | — | — | — | — | — | — | — | — | — | — |
| | Cover | inner | — | — | — | — | — | — | — | — | — | 0 | 0 | 0 |
| | | central | — | — | — | — | — | — | — | — | — | — | — | — |
| | | outer | — | — | — | — | — | — | — | — | — | 1 | 12 | 12 |
| Micro-modulus | Center | inner | — | — | — | — | — | — | 0 | 0 | 0 | — | — | — |
| | | outer | — | — | — | — | — | — | 4 | 11 | 7 | — | — | — |
| | IL 1 | inner | 1 | 28 | 28 | 0 | 0 | 0 | — | — | — | — | — | — |
| | | central | 0 | 0 | 0 | — | — | — | — | — | — | — | — | — |
| | | outer | 1 | 750 | 750 | 1 | 15 | 15 | — | — | — | — | — | — |
| | IL 2 | inner | — | — | — | — | — | — | — | — | — | — | — | — |
| | | central | — | — | — | — | — | — | — | — | — | — | — | — |
| | | outer | — | — | — | — | — | — | — | — | — | — | — | — |
| | Cover | inner | — | — | — | — | — | — | — | — | — | 0 | 0 | 0 |
| | | central | — | — | — | — | — | — | — | — | — | — | — | — |
| | | outer | — | — | — | — | — | — | — | — | — | 1 | 16 | 16 |
| Micro-Melt Flow | Center | inner | — | — | — | — | — | — | 0 | 0 | 0 | — | — | — |
| | | outer | — | — | — | — | — | — | 30 | 80 | 70 | — | — | — |
| | IL 1 | inner | 1 | 25 | 25 | 0 | 0 | 0 | — | — | — | — | — | — |
| | | central | 0 | 0 | 0 | — | — | — | — | — | — | — | — | — |
| | | outer | 1 | 98 | 98 | 1 | 100 | 100 | — | — | — | — | — | — |
| | IL 2 | inner | — | — | — | — | — | — | — | — | — | — | — | — |
| | | central | — | — | — | — | — | — | — | — | — | — | — | — |
| | | outer | — | — | — | — | — | — | — | — | — | — | — | — |
| | Cover | inner | — | — | — | — | — | — | — | — | — | 0 | 0 | 0 |
| | | central | — | — | — | — | — | — | — | — | — | — | — | — |
| | | outer | — | — | — | — | — | — | — | — | — | 1 | 70 | 70 |

Ball Properties Absolute Difference from the Corresponding Comparative Example

| | Example 1 | Example 2 | Example 3 | Example 4 |
|---|---|---|---|---|
| Shear Rating | 0 | 0 | 0 | +1 |
| CoR, @125 fps | +0.010 | +0.003 | +0.001 | +0.002 |
| Atti Compression | +5 | +2 | +1 | +1 |
| Driver Spin, rpm | −150 | −50 | −50 | −100 |

*In Table III, The term "IL" denotes "intermediate layer" and the term "Sf" denotes "surface".

Unless otherwise expressly specified, all of the numerical ranges, amounts, values and percentages such as those for amounts of materials, and others in the specification may be read as if prefaced by the word "about" even though the term "about" may not expressly appear with the value, amount or range. Accordingly, unless indicated to the contrary, the numerical parameters set forth in the specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

While it is apparent that the illustrative embodiments of the invention disclosed herein fulfill the preferred embodiments of the present invention, it is appreciated that numerous modifications and other embodiments may be devised by those skilled in the art. Examples of such modifications include reasonable variations of the numerical values and/or materials and/or components discussed above. Hence, the numerical values stated above and claimed below specifically include those values and the values that are approximate to those stated and claimed values. Therefore, it will be understood that the appended claims are intended to cover all such modifications and embodiments, which would come within the spirit and scope of the present invention.

The invention described and claimed herein is not to be limited in scope by the specific embodiments herein disclosed, since these embodiments are intended as illustrations of several aspects of the invention. Any equivalent embodiments are intended to be within the scope of this invention. Indeed, various modifications of the invention in addition to those shown and described herein will become apparent to those skilled in the art from the foregoing description. For example, the compositions of the present invention may be used in a variety of equipment. Such modifications are also intended to fall within the scope of the appended claims.

While any of the embodiments herein may have any known dimple number and pattern, a preferred number of dimples is 252 to 456, and more preferably is 300 to 392. The dimples may comprise any width, depth, and edge angle and patterns which satisfy the relationships defined between cover layers as disclosed herein. The parting line configuration of said pattern may be either a straight line or a staggered wave parting line (SWPL). In one embodiment, the golf ball has 302, 320, 328, 330, 332, 352 or 392 dimples, comprises 5 to 7 dimples sizes, and the parting line is a SWPL.

In any of these embodiments the single-layer core may be replaced with a two or more layer core wherein at least one core layer has a negative hardness gradient. Other than in the operating examples, or unless otherwise expressly specified, all of the numerical ranges, amounts, values and percentages such as those for amounts of materials and others in the specification may be read as if prefaced by the word "about" even though the term "about" may not expressly appear with the value, amount or range.

Accordingly, unless indicated to the contrary, the numerical parameters set forth in the specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

What is claimed is:

1. A golf ball comprising a core, a cover and optionally an intermediate layer disposed between the core and the cover, wherein at least one of the core, the at least one intermediate layer, and the cover comprises at least one of an ionomer and an acid copolymer and has an untreated region and at least one treated region that is treated with and comprises a reaction product of an organometallic composition and the at least one ionomer and/or acid copolymer, such that the untreated region and at least one treated region, in tandem, have an external neutralization gradient.

2. The golf ball of claim 1, wherein the organometallic composition comprises at least one of an alkyl metal and an aryl metal.

3. The golf ball of claim 2, wherein the alkyl comprises the formula $C_nH_{2n+1}$, wherein $1 \leq n \leq 8$.

4. The golf ball of claim 2, wherein the alkyl comprises the formula $C_nH_{2n+1}$, wherein $n>8$.

5. The golf ball of claim 2, wherein the aryl comprises phenyls and substituted phenyls.

6. The golf ball of claim 1, wherein the organometallic composition further comprises at least one aprotic solvent selected from the group comprising hexanes, heptanes, toluene, and xylene.

7. The golf ball of claim 1, wherein the organometallic composition further comprises at least one ether.

8. The golf ball of claim 7, wherein the ether comprises a dialkylether selected from the group comprising diethyl ether and dibutyl ether.

9. The golf ball of claim 1, wherein the external neutralization gradient is a percentage point difference in degree of neutralization between surfaces of the treated region and the untreated region of up to about 100 percent.

10. The golf ball of claim 9, wherein the untreated treated region surrounds the treated region.

11. The golf ball of claim 9, wherein the treated region surrounds the untreated region.

12. The golf ball of claim 1, wherein the treated region is adjacent the untreated region, and the untreated region has a depth that is less than a depth of the treated region.

13. The golf ball of claim 1, wherein the treated region is adjacent the untreated region, and the untreated region has a depth that is greater than a depth of the treated region.

14. A golf ball comprising a core, a cover and optionally an intermediate layer disposed between the core and the cover, wherein at least one of the core, the at least one intermediate layer, and the cover comprises at least one of an ionomer and an acid copolymer and has an untreated region and at least one treated region that is treated with and comprises a reaction product of an organometallic composition and the at least one ionomer and/or acid copolymer, such that the untreated region and at least one treated region, in tandem, have an external property gradient.

15. The golf ball of claim 14, wherein the property gradient is a % difference in hardness.

16. The golf ball of claim 14, wherein the property gradient is a % difference in modulus.

17. The golf ball of claim 14, wherein the property gradient is a % difference in melt flow.

18. A golf ball comprising a core, a cover and optionally an intermediate layer disposed between the core and the cover, wherein at least one of the core, the at least one intermediate layer, and the cover comprises at least one of an ionomer and an acid copolymer and further comprises at least two regions, wherein the at least two regions comprises an untreated region and at least one treated region that is treated with and comprises a reaction product of an organometallic composition and the at least one ionomer and/or acid copolymer, such that the treated region and the untreated region, in tandem, have an external neutralization gradient wherein at least one of a hardness, a modulus and a melt flow of the at least two regions is different.

* * * * *